United States Patent [19]

Sawamura et al.

[11] Patent Number: 5,012,299

[45] Date of Patent: Apr. 30, 1991

[54] COLOR ADJUSTMENT APPARATUS FOR COLOR COPYING MACHINE

[75] Inventors: Tadahide Sawamura, Tokyo; Yoko Nakamura, Kawasaki; Fumiyo Kojima, Mitaka, all of Japan

[73] Assignee: Ricoh Company, Ltd., Tokyo, Japan

[21] Appl. No.: 256,861

[22] Filed: Oct. 12, 1988

[30] Foreign Application Priority Data

| | | | |
|---|---|---|---|
| Oct. 16, 1987 | [JP] | Japan | 62-261357 |
| Mar. 7, 1988 | [JP] | Japan | 63-52981 |
| Mar. 8, 1988 | [JP] | Japan | 63-54663 |
| Jun. 1, 1988 | [JP] | Japan | 63-134721 |

[51] Int. Cl.[5] ..... G03G 15/01

[52] U.S. Cl. ..... 355/326; 355/246; 355/77; 358/80

[58] Field of Search ..... 355/326, 327, 208, 219, 355/228, 245, 246, 77; 346/157; 358/75, 80

[56] References Cited

U.S. PATENT DOCUMENTS

| | | | |
|---|---|---|---|
| 4,204,728 | 5/1980 | Goshima et al. | 355/209 X |
| 4,893,179 | 1/1990 | Ito | 355/327 X |

*Primary Examiner*—R. L. Moses

*Attorney, Agent, or Firm*—Oblon, Spivak, McClelland, Maier & Neustadt

[57] ABSTRACT

A color adjustment apparatus for a color picture image reproducing machine, the apparatus includes a color chart for visually representing all real colors in terms of color elements of saturation and hue, and a touch-key for inputting color adjustment data to the color copying machine, the color adjustment data relates to one of the colors corresponding to a pressed point on the color chart.

31 Claims, 20 Drawing Sheets

COLOR ADJUSTMENT APPARATUS FOR COLOR COPYING MACHINE

BACKGROUND OF THE INVENTION

1. Field of the invention

The present invention relates to a color adjustment apparatus for a color picture image reproducing machine.

2. Discussion of the background

In general, conventional analog color copying machines require color adjustment since there are many cases where the color tone of a copy image which has been produced from an original document differs from the original color tone. Such color adjustment is very important, but it involves difficulties in technical terms.

In a conventional type of color adjustment system, the color tone of a copy image is adjusted or corrected by separating the original color into the three elements of color, that is, brilliance, saturation and hue and inputting the amount of color adjustment for each of the elements by a predetermined key operation. Specifically, exposure outputs, main-charge outputs, development bias outputs and the like are adjusted by operating a variable resistor or the like in order to effect color adjustment. As a result, it is difficult for a user to transmit to the copying machine his desire to make the color of a copy slightly dim or somewhat closer to orange. For this reason, it is difficult for the user to perform the desired color adjustment.

The input system for the amount of color adjustment in such a conventional color adjustment system is typically arranged such that the amount of color adjustment is input by incrementing or decrementing a numerical value through the operation of keys provided with symbols or numbers such as "+", "−", "1", "2", "3", "4" and "5". However, such a system has the following problems. Since such symbols or numbers have no visual appeal, the user cannot understand how the color changes as a result of the increment or decrement based on a single key operation. It is therefore difficult for the user to accomplish the desired color correction through a single operation. In other words, the user cannot understand whether the color has been adjusted by the desired amount until a trial copy is actually produced. For this reason, the user requires a certain learning period until he grasps the performance of the copying machine.

In such a conventional color adjustment system, a plurality of keys for each of brilliance, saturation and hue must be laid out on an operating panel. As a result, the user may have an impression that the operation of the machine is difficult. In addition, in the current situation in which color copying machines are used in various countries, the function of each key must be represented in a variety of languages. This leads to an increase in the number of production steps, and there is a risk that a discrepancy may occur between the image associated with a functional representation and the actual result of corresponding control.

Briefly, such a conventional type of color adjustment system has the problem that a difficult operation is required and that, if the operability is improved, a desired color copy cannot be obtained.

Such a full-color copying machine typically employs three kinds of color toner, that is, yellow Y toner, magenta M toner and cyan C toner, and is capable of producing a full-color copy by a combination of these three kinds as well as a single-color copy (monocolor copy). Therefore, it is possible to provide single-color copies of the six colors yellow Y, magenta M, cyan C, blue B (a combination of magenta M and cyan C), green G (a combination of yellow Y and a cyan C) and red R (a combination of yellow Y and magenta M). Some types of copying machines are arranged so that single-color copies of twelve colors such as Y, M, C YM, YC, MC, YYM, YMM, MMC, MCC YYC and YCC can be provided by a combination of the toner of the three kinds of Y, M and C.

As described above, when a single-color copy is to be produced with such a conventional type of color copying machine, it is impossible to select a desired single color from among many kinds of colors since each color is only reproduced by either one selected from the three kinds of toner Y, M and C or a combination of two of the three.

Many of the conventional color copying machines are arranged such that a color selecting operation in the above-described single-color copying operation is performed by specifying a character key such as a "RED" key or a "YELLOW" key on an operating panel. Therefore, there are many cases where the color of a copy image which has been produced from an original is not the same as the color which the user imaged. In addition, in order to enable twelve kinds of single-color copies, it has been necessary to lay out twelve single-color selection keys on the operating panel. Accordingly, since an increased number of keys must be arranged, users may have the impression that the operation of the operating panel is difficult and complicated.

SUMMARY OF THE INVENTION

It is a first object of the present invention to provide a color adjustment apparatus for a color picture image reproducing machine which is capable of displaying, and allows input of, the amount of color adjustment in a simple manner such that a user can readily understand the required amount of color adjustment of the color which he desires to correct when the color tone of a copy image differs from that of an original image.

According to the present invention, said first object is achieved by a first color adjustment apparatus for a color picture image reproducing machine, comprising;

(a) a color chart for visually representing all real colors in terms of color elements of saturation and hue, and (b) an input means of a touch-key structure for imputting color adjustment data to said color copying machine, said color adjustment data relating to one of said colors corresponding to a pressed point on said color chart.

According to the first embodiment of the present invention, an input operation for color adjustment can be executed by means of both the color chart which visually represents all the color tone and input means having a touch-key structure corresponding to the hue arrangement of the color chart. Accordingly, as compared with a system in which the amount of color adjustment is input as a numerical value, it is possible for any person having no special skill to input desired color information by touching the real-color portion of the color chart with a finger. Since the input operation is performed with reference to a real color, a user can exactly transmit to the copying machine the desired color which he has imaged.

It is a second object of the present invention to provide a color adjustment apparatus for a color picture image reproducing machine which excels in operability since it can cope with the adverse influences of environmental changes which may be encountered when the above-described color adjustment input apparatus featuring a visible display and an easy input operating is used.

According to the present invention, said second object is achieved by a second color adjustment apparatus for a color picture image reproducing machine, comprising;

(a) a color chart for visually representing all real colors in terms of color elements of saturations and hue, (b) a store means for storing reference data for each of exposure data, charging data and development bias data all of which relate to one of said colors corresponding to a pressed point on said color chart, (c) a fetching means of a touch-key structure for fetching from said store means said reference data relating to two of said colors corresponding to two pressed point on said color chart, (d) a calculating means for receiving a difference data between said inputted reference data from two pressed points on said color chart and for calculating at least one of exposure data, charge data and development bias data on the basis of said reference data, (e) an instruction means for instructing an execution of a copying operation to said copying machine on the basis of said calculation of at least one of said exposure data, said charge data and said development bias data, and (f) a substituting means for substituting said calculation of at least one of said exposure data, said charge data and said development bias data for said reference data of said store means, on every completion of said copying operation.

According to the second embodiment of the present invention, each time color copying accompanying a color adjustment operation has been performed, the reference data for color adjustment is updated on the basis of adjusted data. Therefore, even if the state of the copying machine varies due to changes in the environment, the subsequent color copying operation is performed according to an optimum reference data according to the adjusted data. Accordingly, subsequent to the required color adjustment, the user does not necessarily perform a color adjustment operation at the time of each copying operation, and it is possible to achieve good operability and easy operation of the color-chart input system.

It is a third object of the present invention to provide a single-color adjustment apparatus for a color copying machine which is capable of producing both full-color copies and single-color copies and of preparing a variety of colors for the production of the single-color copies, which apparatus includes an input mechanism which enables easy specification of the desired single color.

According to the present invention, said third object is achieved by a fourth color adjustment apparatus for a color picture image reproducing machine, comprising;

(a) a color chart for visually representing a plurality of single-colors by means of real colors, (b) an input means for sensing a position of a pressed point on said color chart and for inputting a single-color data for at least one of exposure data, charge data and development bias data all of which relate to said single-color corresponding to said pressed point, and (c) an instruction means for instructing an excecution of a copying operation to said copying machine by controlling at least one of an exposure data output, a charge data output and a development bias data output on the basis of said single-color data from said input means.

According to the third embodiment of the present invention, it is provided with both the color chart which visually represents real colors and input means corresponding to the hue arrangement of the color chart, so that a desired single color can be selected and input by pressing the color chart. Accordingly, as compared with a system in which the selection of a single color is performed by operating a character key, it is possible for any person having no special skill to easily input desired single-color information by touching the real-color portion of the color chart with his finger. Since the input operation is performed with reference to the real color, the user can exactly transmit the desired color which he has imaged to the copying machine, thereby causing it to perform a variety of single-color copies by a combination of three kinds of color toner.

The above mentioned color picture image reproducing machine may comprise an analogue color copying machine, or a digital copying machine.

The above and other objects, features and advantages of the present invention will become apparent from the following description, when read in conjunction with the accompanying drawings.

DESCRIPTION OF THE PREFERRED EMBODIMENTS

Preferred embodiments of the present invention will be described hereinafter with reference to the accompanying drawings.

The present invention should not be taken as being restricted to the embodiments described hereinunder. Various changes and modifications are possible to those skilled in the art without departing from the spirit and scope of the present invention.

A first embodiment of the present invention will be described below with reference to FIGS. 1 through 13.

Figure 1:
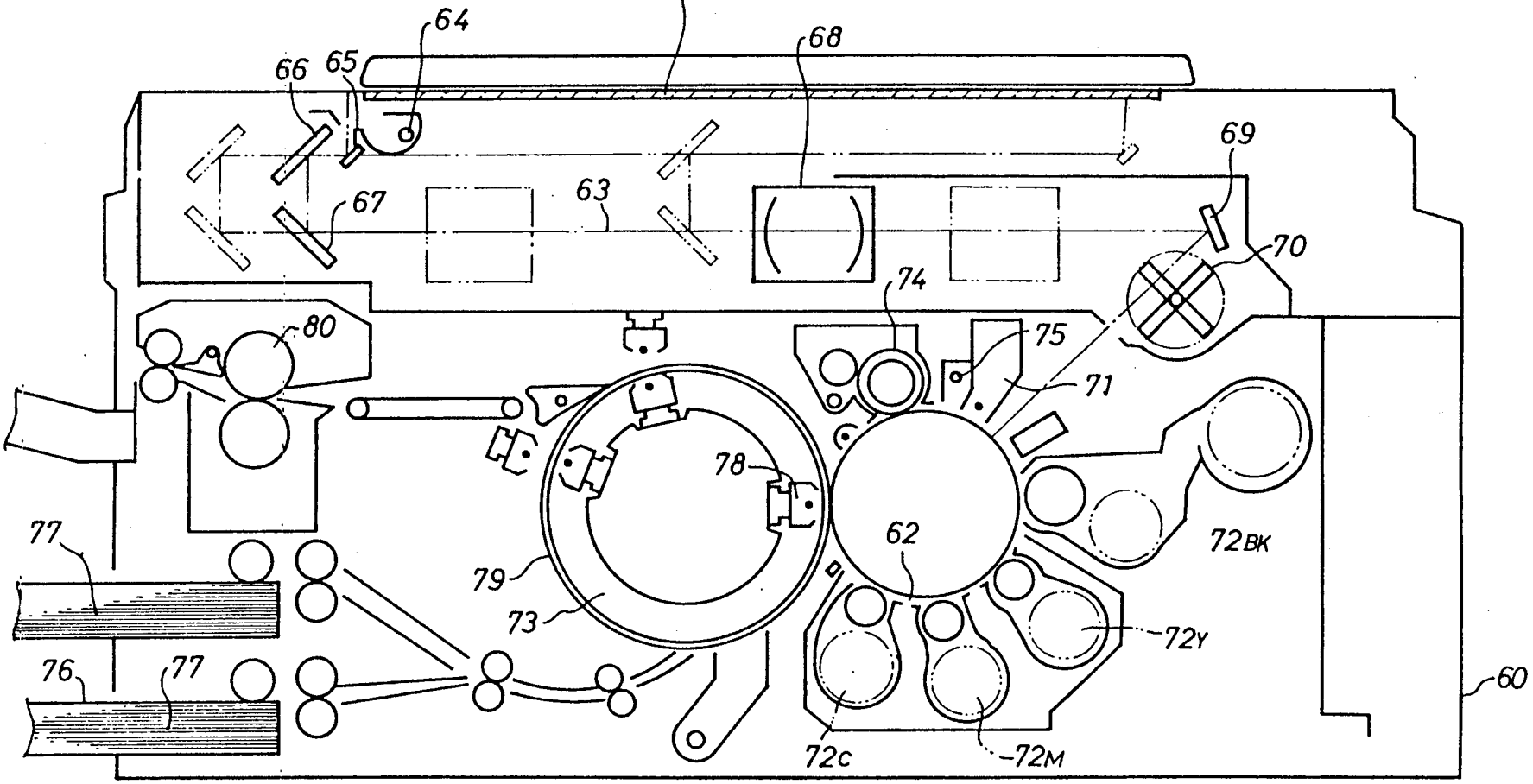
FIG. 1 is a diagrammatic side elevational view, with portions in section, of the entire structure of a color copying machine according to a first apparatus of the present invention.

The construction and operation of an analog type of full-color copying machine to which the first embodiment is applied will be first described with specific reference to FIG. 1.

The body of a copying machine is indicated generally at 60, and a contact glass plate 61 for carrying an original document (not shown) is disposed on the top of the body 60. An optical system 63 is disposed below the contact glass plate 61 for allowing the original document to be scanned with exposure light so as to focus the scanned image onto a photosensitive member 62. More specifically, in the optical system 63, the original document is exposed to the light of an exposure lamp 64 and light reflected from the original document is focused onto the photosensitive member 62 through the optical path formed by a first mirror 65, a second mirror 66, a third mirror 67, a focusing lens 68 and the fourth mirror 69. As is well known, the exposure lamp 64 and the first mirror 65 constitute a first scanner, while the second mirror 66 and the third mirror 67 constitute a second scanner. The first scanner and the second scanner are arranged to travel for scanning purposes at a velocity ratio of 2:1. The second scanner and the focusing lens 68 are displaced according to variations in magnification. The body 60 further includes a color separation filter device 70 which is rotatably disposed in the optical path of the light reflected from the fourth mirror 69 so that each color filter of the filter device 70 is selectively located on the optical path. The color separation filter device 70 functions to separate the original image into the three color images of red (R), green (G) and blue (B) and sequentially form these three primary color images on the photosensitive member 62, thereby enabling the copying machine to serve as a color copying machine.

As illustrated, in accordance with the procedure of a typical electrophotographic process, an electrostatic charger 71, an image forming section which is exposed to light reflected by the fourth mirror 69, a development device 72, a transfer device 73, a cleaning device 74, and a de-electrifying lamp 75 are disposed around the photosensitive member 62. The development device 72 is provided with a development unit $72_{BK}$ employing black toner for black-and-white copying, as well as a development unit $72_Y$ employing yellow toner, a development unit $72_M$ employing magenta toner, and a development unit $72_C$ employing cyan toner, all three of which are adapted to be used for full-color copying. The transfer device 73 is provided with a transfer charger 78 which is adapted to transfer the image developed on the photosensitive member 62 onto transfer paper 77 which is fed from a paper supply cassette 76. The transfer device 73 is further provided with a transfer drum 79 which is adapted to rotate about its axis with the transfer paper 77 clamped thereto so as to enable repetitive transfer of developed images onto one sheet of transfer paper 77, the developed images each consisting of a different color and being combined to form an identical full-color image. Full descriptions of the clamping means and separation means are omitted for the sake of simplicity. A fixation device 80 is provided in the direction of advancement of the transfer paper 77 which is separated from the transfer drum 79 after the repetitive transfer.

In the above-described construction, copying of a common black-and-white original document is performed in the following manner. The latent image that corresponds to an original image is formed on the photosensitive member 62, subjected to development with black toner by the development unit $72_{BK}$, transferred onto the transfer paper 77, and discharged from the machine after fixation.

Color copying from a color original document is performed in the following manner. In a first exposure scan, a red (R) light image which has been selected by the color separation filter device 70 is solely focused on the photosensitive member 62, developed with yellow toner by the development unit $72_Y$, and transferred onto the transfer paper 77. In a second exposure scan, a green (G) light image which has been selected by the color separation filter device 70 is solely focused on the photosensitive member 62, developed with magenta toner by the development unit $72_M$, and transferred onto the same transfer paper 77 that has again been conveyed to a transfer position while being carried on the transfer drum 79. Furthermore, in a third exposure scan, a blue (B) light image which has been selected by the color separation filter device 70 is solely focused on the photosensitive member 62, developed with cyan toner by the development unit $72_C$, and transferred onto the same transfer paper 77 which has again been conveyed to the transfer position while being carried on the transfer drum 79. Thus, three color images are superimposed on the same sheet of transfer paper 77 to provide a full-color copy.

Figure 2:
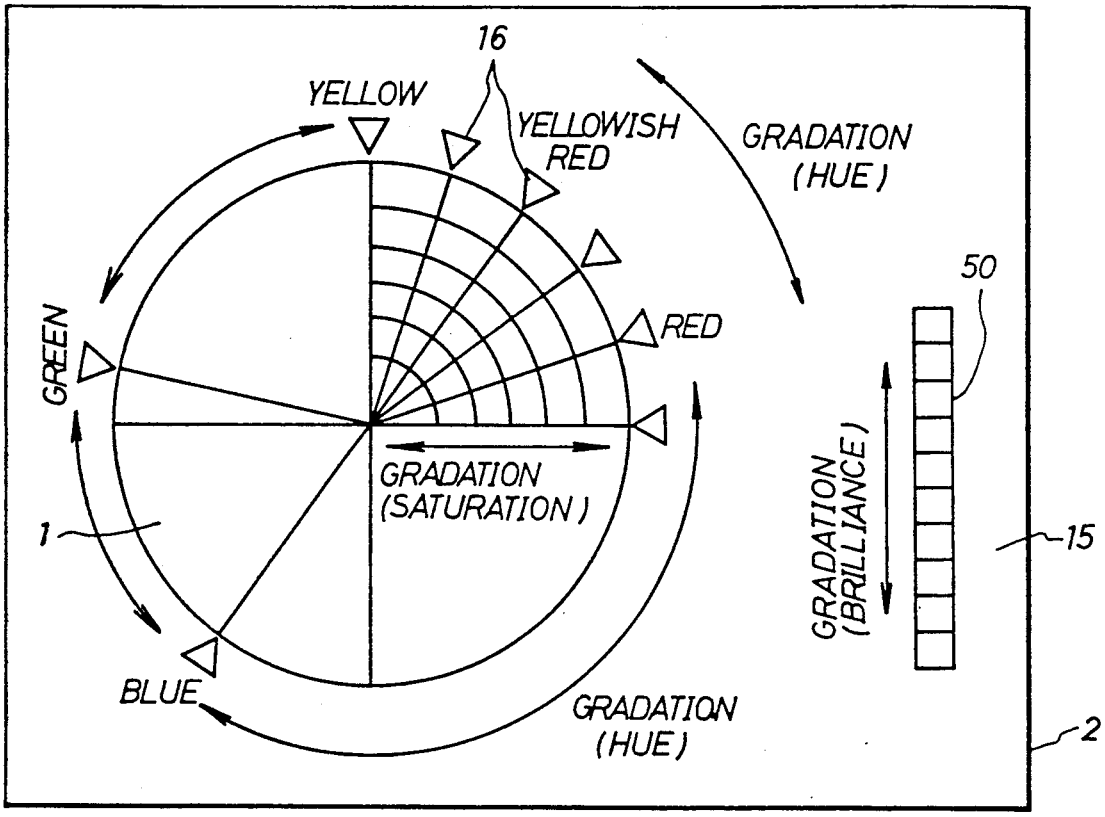
FIG. 2 is a top plan view of an example of the color circle printed sheet used in the first apparatus.
Figure 3:
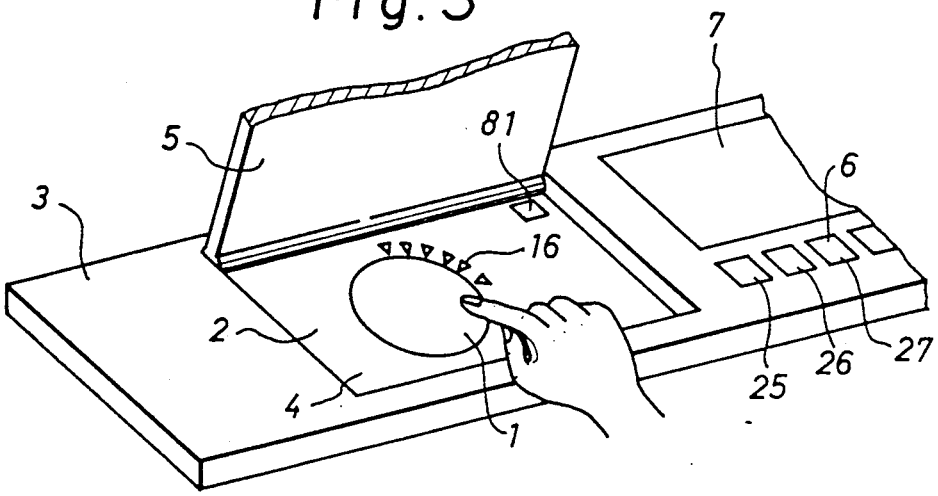
FIG. 3 is a diagrammatic perspective view of the operating section used with the color copying machine shown in FIG. 1.

The following is a description of a color chart system which serves as a color adjustment input device according to the first embodiment. In this embodiment, a color circle such as that shown in FIG. 2 is employed as a color chart. The color circle 1 is printed on the back side of a color-circle printed sheet 2. As shown in FIG. 3, the color-circle printed sheet 2 is set in an operating section 3 to constitute a color adjustment section 4. Reference numeral 5 denotes a cover, and the color adjustment section 4 is normally covered by the cover 5. In FIG. 3, reference numeral 6 denotes the key top of each key, and reference numeral 7 denotes a display panel capable of providing a liquid-crystal dot-matrix display.

Figure 4:
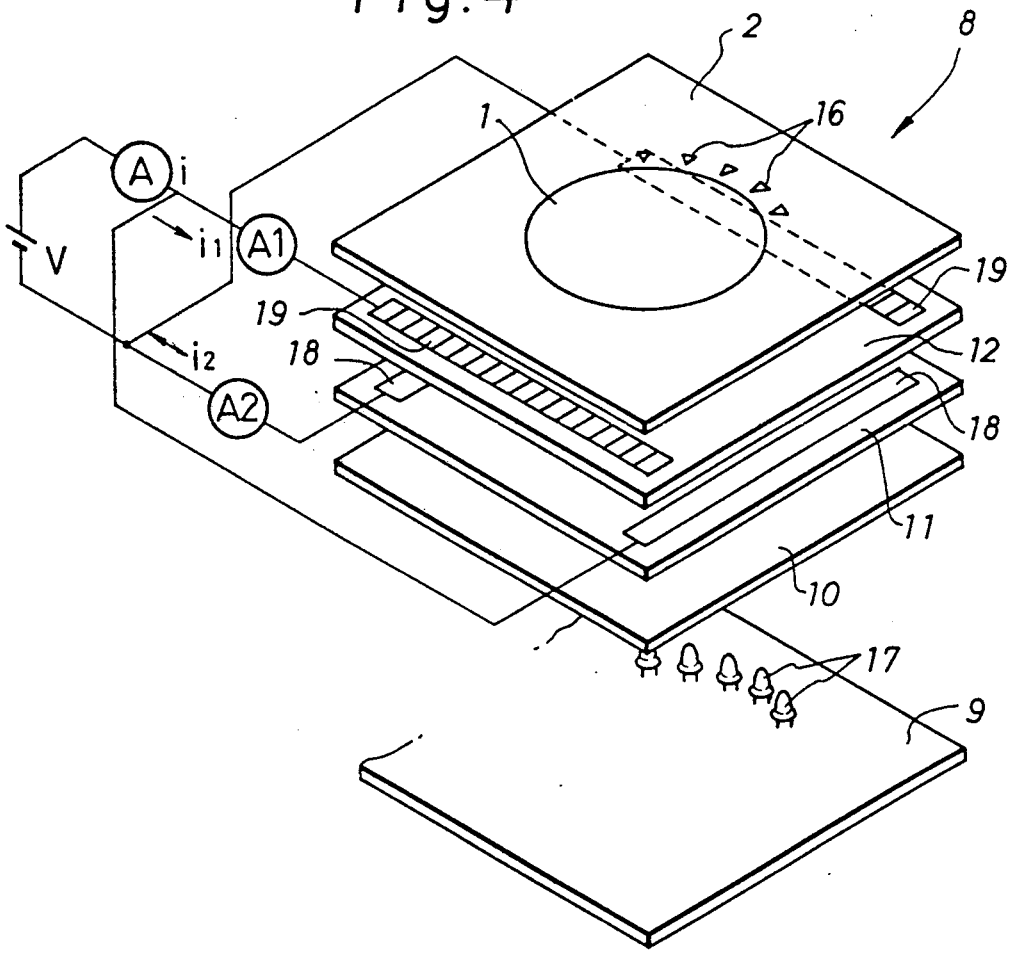
FIG. 4 is an exploded perspective view showing the touch-key structure of the first apparatus.

The aforesaid color adjustment section 4 has a touch-key arrangement (similar to an ordinary editor board) comprised of a touch key 8 and a digitizer sheet arrangement such as that shown in FIG. 4, which includes the color-circle printed sheet 2 with the color circle 1 formed thereon. More specifically, a conductive sheet 10, an X-direction electrode sheet 11, a Y-direction electrode sheet 12 and the color-circle printed sheet 2 are sequentially superimposed on the printed wiring board 9. More specifically, the color circle 1 is provided to allow a user to input a desired color by pressing an appropriate portion thereof with his finger.

The color-circle printed sheet 2, the color circle 1 and the associated portions will be further described below. The color-circle printed sheet 2 has a base constituted by a transparent resin sheet 15, and the color circle 1 is printed on the back of the transparent resin sheet 15. The color circle 1 visually represents all the real colors in terms of the two color elements of saturation and hue. In the color circle 1, specifically based on the ten hues of the Munsell color system, the real colors of yellow, yellowish red, red, reddish purple, purple, purplish blue, blue, bluish green, green, and yellowish green are laid out in that order from the top, moving in the clockwise direction at a pitch of 18°. Triangular non-printed portions are formed on the transparent resin sheet 15 at twenty positions indicative of a plurality of points around the circumference of the color circle 1, that is, the ten hues of the Munsell color system and the respective intermediate hues, the triangular non-printed portions constituting LED indication portions 16. LEDs 17 are formed on the printed wiring board 9 at locations corresponding to the respective LED indication portions 16.

Figure 5:
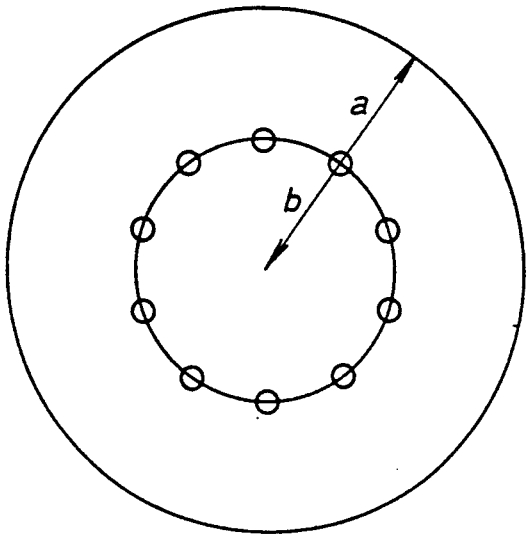
FIG. 5 is an illustration showing the hue distribution in a color circle according to the first embodiment.

The color circle 1 is printed so that the area between each adjacent hue is subdivided with the color in the area progressively changing. Curved arrows shown in FIG. 2 along the circumference of the color circle 1, for example "yellow $\xleftarrow{\text{GRADATION (HUE)}}$ yellowish red"

represents that the hue between yellow and yellowish red is subdivided so that the color in the area progressively changes. Saturation progressively changes(as represented by gradation (saturation)) in the radial direction of the color circle 1. More specifically, as shown in FIG. 5, the color circle 1 is printed so that the hues on a concentric circle the radius of which is half that of the color circle 1 are set as basic colors, and the colors of the color circle 1 become progressively bright and light radially outwardly and progressively dark and dim radially inwardly. As shown in FIG. 5, each small circle indicates a portion at which the basic color of each hue is printed, and an arrow (a) indicates that a corresponding color becomes progressively bright and light radially outwardly from the basic-color point on the circumference of the concentric circle, while an arrow (b) indicates that the color becomes progressively dark and dim radially from the basic-color point toward the center. The color circle 1 is printed such that, for example, if the basic color is red, the red progressively changes to pink from the basic-color point toward the circumference of the color circle 1, but to brown from that point toward the center. In this manner, the color circle 1 is printed such that all the colors are contained in the same.

On the other hand, the brilliance gradation row 50 is printed adjacent to the color circle 1 on the back of the transparent resin sheet 15. The brilliance gradation row 40 visually represents the brilliance gradation.

Referring to the touch key 8, the electrode plates 11 and 12 are each constituted by a transparent sheet, and X-direction electrodes 18 are printed on the electrode plates 11 and Y-direction electrodes 19 are printed on the electrode plates 12, respectively. The conductive sheet 10 is made of a shielding material.

Thus, as will be described in detail below, when a user presses an arbitrary portion in the color circle 1 with his finger, the X and Y coordinates of the pressed portion are specified from a measurement value $i_2$ provided by an ammeter A2 connected between the opposed X-direction electrodes 18 and a measurement value $i_1$ provided by an ammeter A1 connected between the opposed Y-direction electrodes 19. It is thus possible to input the data corresponding to the pressed portion. An ammeter A is disposed to measure the current i of the entire circuit, and an applied voltage is represented by V. Each of the LEDs 17 on the board 9 is adapted to operate in association with such a pressing operation, and a lit one of the LEDs 17 is visually confirmed through a corresponding LED indication portion 16 which is constituted by a non-printed portion. The LEDs 17 serve to visibly inform the user where he presses on the color circle 1.

Figure 6:
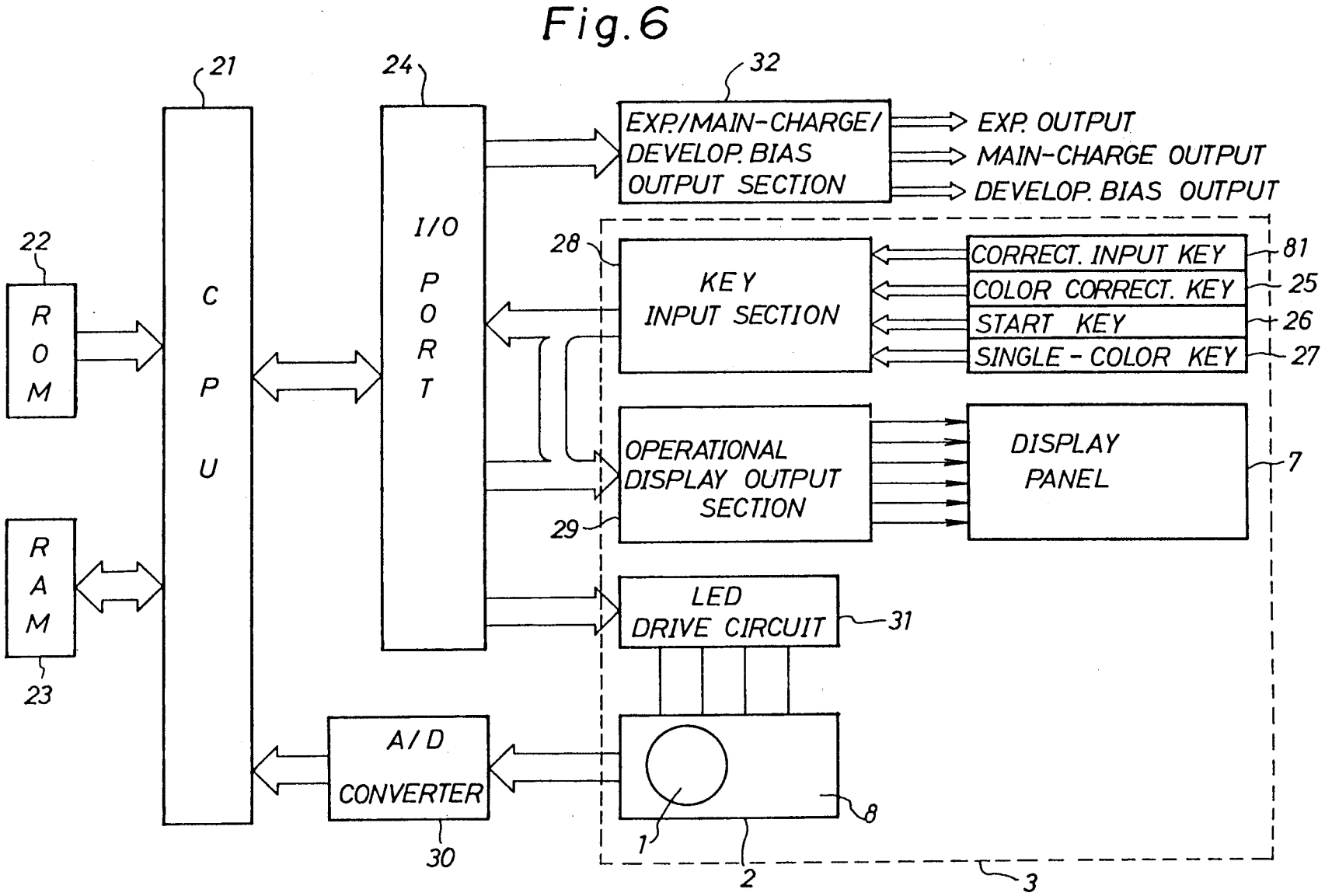
FIG. 6 is a block diagram according to the first embodiment.
Figure 7A:
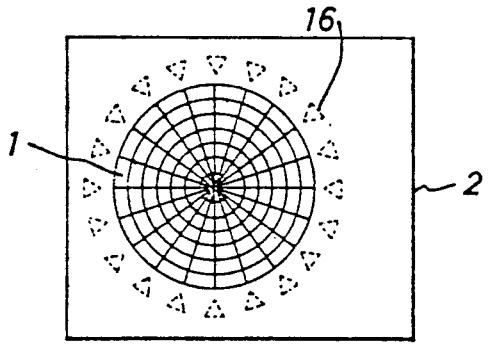
FIGS. 7(*a*) to 7(*d*) are diagrammatic plan views which serve to illustrate the procedure of operation of the color circle.
Figure 7B:
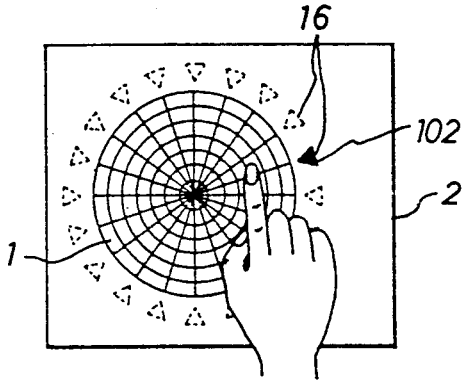
Figure 7C:
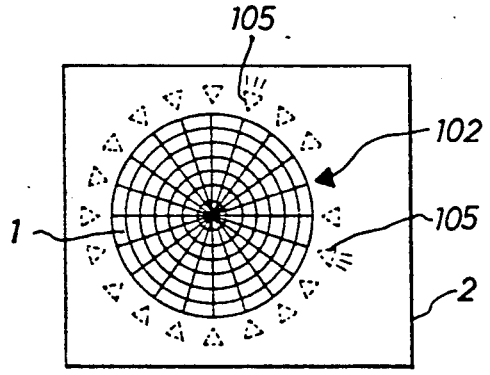
Figure 7D:
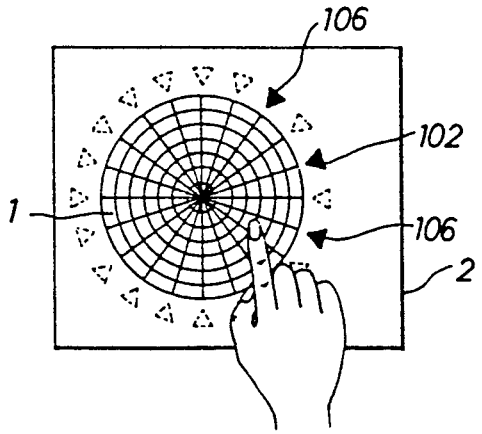
Figure 8A:
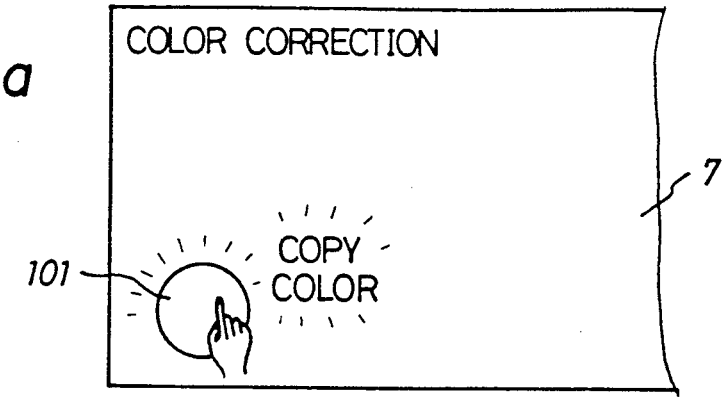
FIGS. 8(*a*) to 8(*d*) are diagrammatic plan views which serve to illustrate a sequence of variations of the visual display provided on a display panel in the first embodiment.
Figure 8B:
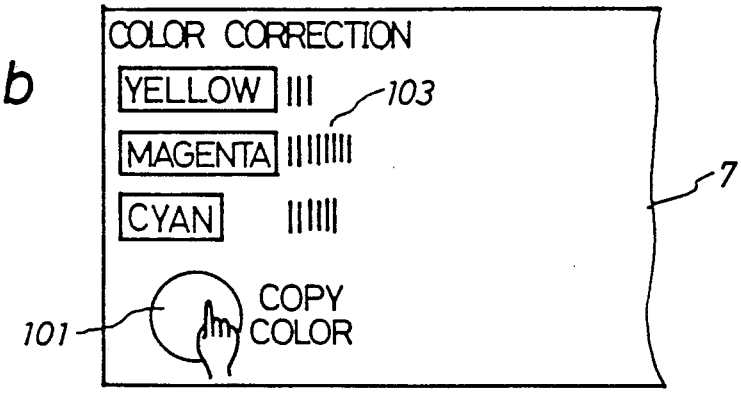
Figure 8C:
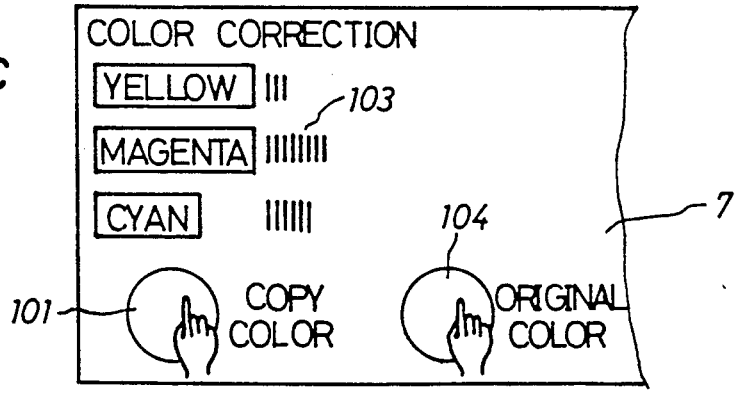
Figure 8D:
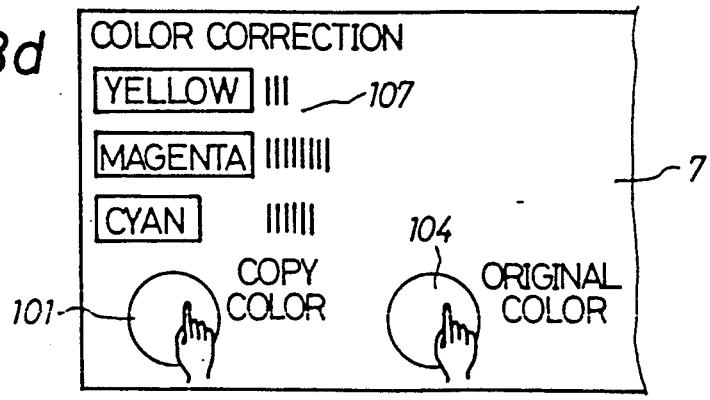

The construction of the control system including the color circle 1 and the control section 3 will be described below with reference to the block diagram of FIG. 6. As illustrated, a CPU 21 is disposed as a means for controlling the entire circuit. A ROM 22 storing programs for control of the CPU 21 is connected to the CPU 21. This ROM 22 stores in advance sets of data for the level of exposure, the level of main charge, and the level of development bias for the three color elements of yellow, magenta and cyan in a color adjustment area on the touch-key portion 8. A RAM 23 is also connected to the CPU 21. Furthermore, an I/O port 24 is connected to the CPU 21 for controlling inputs and outputs in accordance with instructions supplied from the CPU 21. The operating section 3 is connected to the CPU 21 through the I/O port 24. The operating section 3 is provided with a key-input section 28 which allows transfer of the signal of a color correction key 25, a start key 26, a single-color key 27 or the like to the CPU 21 or the like. Also, the display panel 7 is connected to the CPU 21 through an operational indication output section 29 to enable various displays. The touch key 8 is connected to the CPU 21 through an A/D converter 30, but bypasses the I/O port 24. Thus, the voltage signal produced by a pressing operation is subjected to analog-to-digital conversion and is fetched by the CPU 21. The LED drive circuit 31 for the LEDs 17 is connected to the CPU 21 through the I/O port 24. Furthermore, an exposure/main-charge/development bias output portion 32 is connected to the CPU 21. This output portion 32 is generally called "power back", and controls the amount of exposure through the exposure lamp, the amount of main charge through the electrostatic charger and the amount of development bias for a development sleeve, on the basis of the image-forming conditions which is output through the I/O port 24 in accordance with the instruction supplied from the CPU 21.

The procedure of color adjustment employing the color circle 1 and the associated circuits in the above-described embodiment will be described below with reference to FIGS. 7 and 8. When the color correction key 25 of the operating section 3 is pressed, a sign representative of "COLOR CORRECTION" and a color-circle image which corresponds to the configuration of the color circle 1 are visually displayed on the display panel 7 as shown in FIG. 8(*a*). Simultaneously, a signal representative of "COPY COLOR" is displayed by flashes of light on the display panel 7 (shown at 101). These displays instruct the user to input the required amount of color adjustment by touching the color circle 1 such as that shown in FIG. 7(*a*). Since the color circle 1 visually represents all the real colors, the user may press a portion corresponding to the desired color by the touch of a finger. The LED 17 corresponding to the pressed portion is turned on to provide an indication. In FIG. 7(*b*), a black triangle represents the LED (shown at 102) which is turned on. In the meantime, as shown in FIG. 8(*b*), the color distribution of the color elements is displayed on the display panel 7 by means of a plurality of parallel bars (shown at 103) which are typically used with graphic equalizers. This color distribution is that of the three primary colors used in an ordinary development process, that is, the color components of yellow, magenta and cyan. Therefore, the user can readily identify the characteristics of a selected copy color. Upon completion of an input operation employing the color circle 1, the signal indicative of "COPY COLOR" on the display panel 7 is switched from a flashing state to a steadily lit state.

As shown in FIG. 8(*c*), a second color circle (shown at 104) and the associated signal indicative of "ORIGINAL COLOR" are displayed on the display panel 7. Next, the operation of making the copy color closer to the original color is requested by the operation of the color circle 1. At this time, any one or ones of the LEDs 17 produce flashes of light to inform the user of a correctable area or areas in the color circle 1 (the color or colors of which can be corrected). In FIG. 7(*c*), the portions shown by flashing triangles (at 105) are the LED portions which produce flashes of light to indicate the respective correctable areas. As shown in FIG. 7(*d*), the area of the color circle 1 which is surrounded by the lighting LEDs 17 is touched by the finger and thus the original color is input. Upon completion of this input operation, the flashing LEDs 17 are switched to a steadily lit state to indicate the relevant area (shown at 106). As shown in FIG. 8(*d*), on the display panel 7, the bar-graph display of the color distribution of yellow, magenta and cyan for the present copy-color input is changed to that for the next original-color input shown at 107. This change of the color distribution informs the user of the amount of variation of each of the colors after the copy color is corrected with the original color. Also, when this input of the original color has been completed, the sign representative of "ORIGINAL COLOR" displayed on the display panel 7 is changed to a flashing state to a steadily lit state. When the color adjustment operation is completed and the start key 26 is pressed, the predetermined change of image-forming conditions (which will be described later) is effected according to the aforesaid input operations, and the color copying is executed. After the copying operation has been completed, the above-described display disappears.

Figure 9:
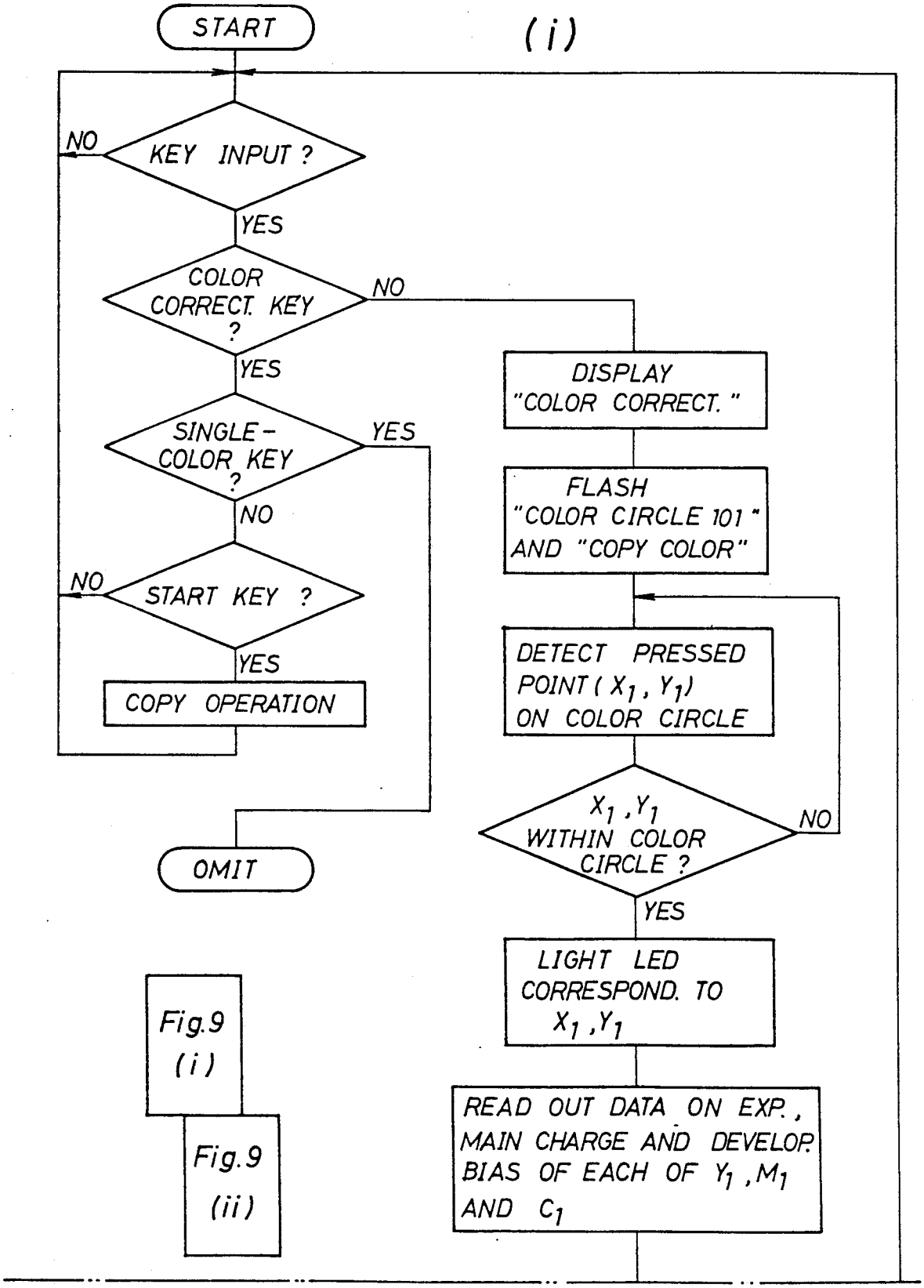
FIG. 9 is a flow chart of various processes such as displaying and calculation executed according to the first embodiment.
Figure 9:
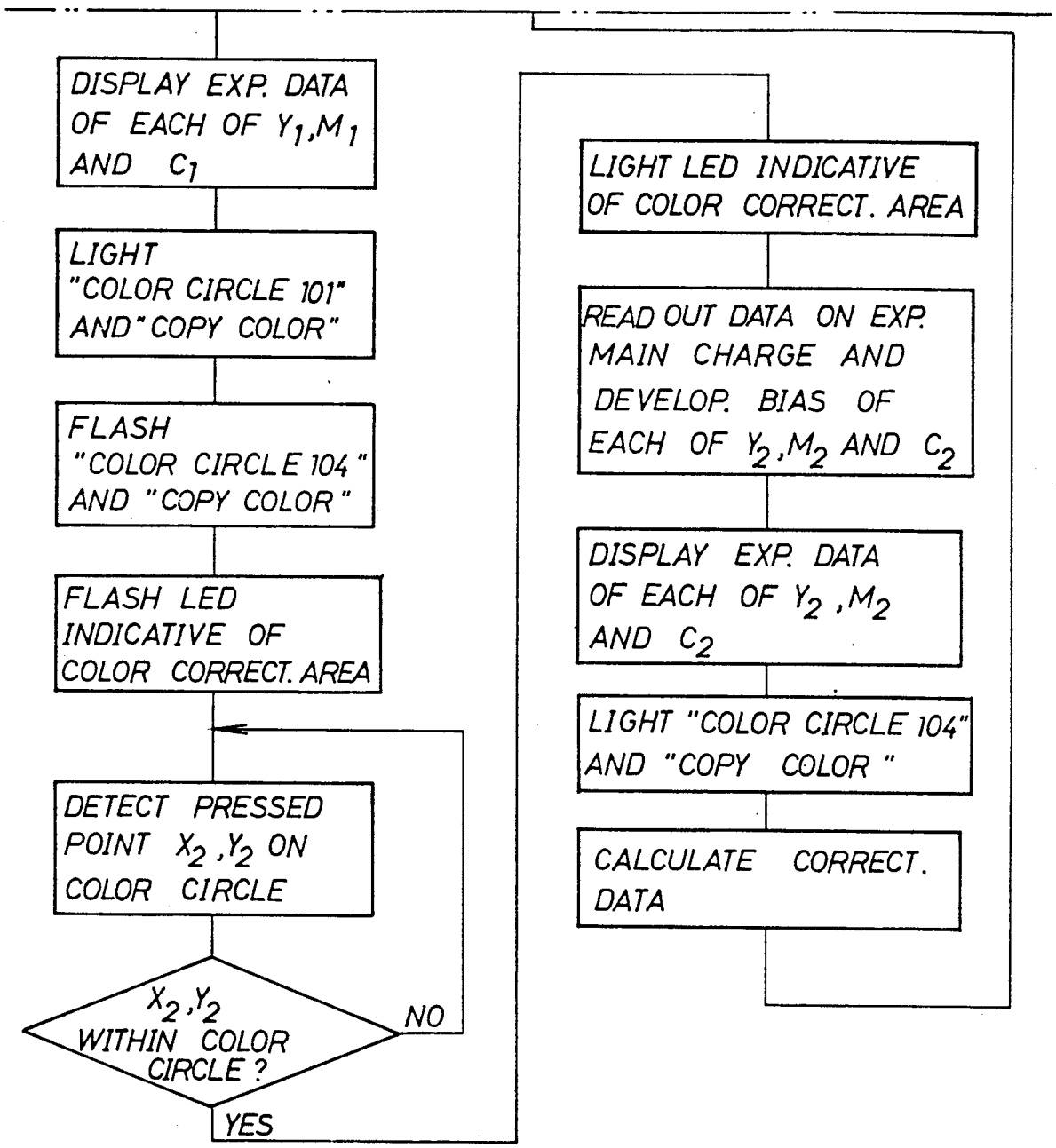

FIG. 9 is a flow chart showing the flow of the operations, displays, processes, and the like which are performed during the above color correction operation.

Figure 10A:
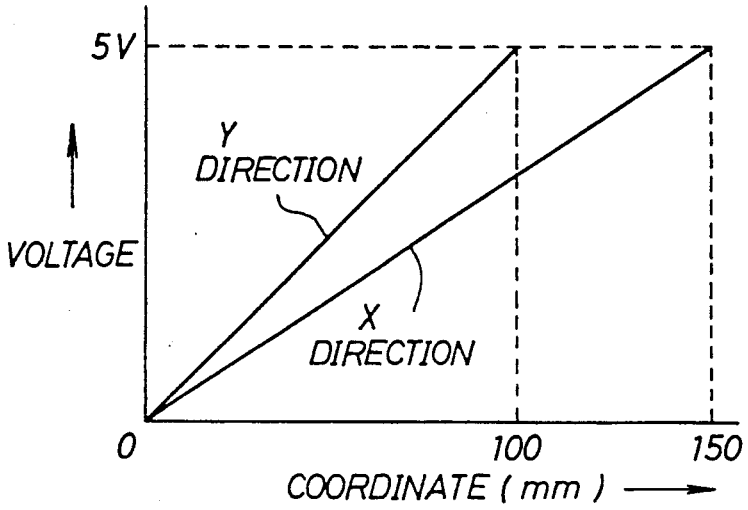
FIGS. 10(*a*) and 10(*b*) are views explanatory of a digitizer sheet according to the first embodiment.
Figure 10B:
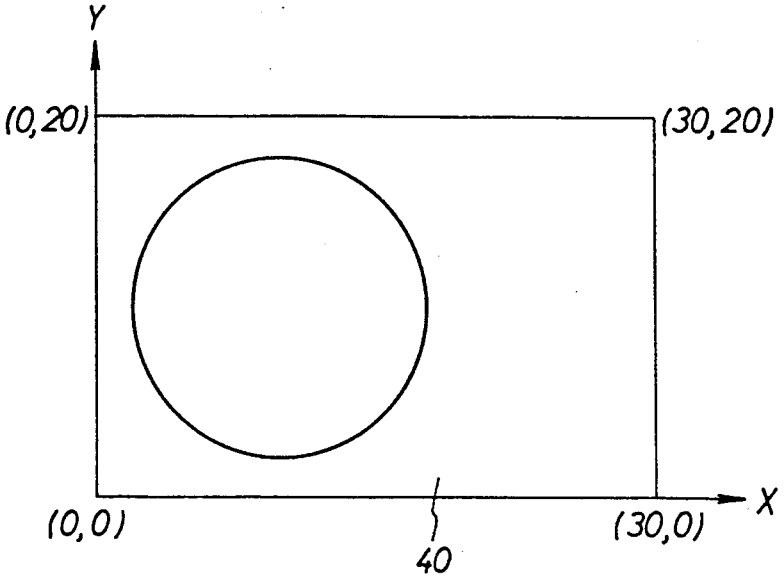

The detection of input positions which is executed in association with the above-described operation on the color circle 1 will be described below. The detection of the position in the color adjustment area which is pressed by the finger of the user during the color correction will be described below with reference to FIGS. 10(*a*) and 10(*b*). FIG. 10(*b*) schematically shows the digitizer sheet 40 of the touch key 8. It is assumed that the digitizer sheet 40 has a size of 150 mm×100 mm. The voltage at each pressed point on the digitizer sheet 40 is shown in FIG. 10(*a*). If it is assumed that the origin of the X and Y coordinate axes is represented, as shown in FIG. 10(*b*), by the bottom left point on the digitizer sheet 40, the voltage at the point on the X coordinate axis that is 150 mm away from the origin is +5 V and the voltage at the point on the Y coordinate axis that is 100 mm away from the origin is +5 V. If the linearity in each of the X-axis and Y-axis directions is good, it is possible to detect the X and Y coordinates of an arbitrary pressed point from the voltage at that point. In order to detect the voltages on the X and Y coordinates, either of the pairs of electrodes 18 or 19 is disposed in either the X-axis or the Y-axis direction. The voltages detected on the X and Y axes are input through the A/D converter 30 to the CPU 21, and thus the coordinate data on the pressed point is provided as a digital value.

In this embodiment, the A/D converter 30 is constituted by, for example, a 10-bit unit, and the X-directional resolution is 150 mm/1024=0.15 mm with the Y-directional resolution being 100 mm/1024=0.1 mm. Therefore, in an actual case, if the input data varies at a pitch as small as 0.1 or 0.15 mm, it will be impossible to change the exposure data, the main-charge data and the development bias data in accordance with such a small variation. Furthermore, since the input operation itself is executed by the touch of a finger, such fine control will not be so important, and no excessive precision will originally be required. In view of this, the pitch in each of the X-axis and Y-axis directions needs only to be the order of several to ten millimeters. This embodiment adopts, for example a 5-mm pitch, and accordingly the X and Y coordinates of the digitizer sheet 40 ranges from (0, 0) to (30, 20) as shown in FIG. 10(*b*).

The following is a description of how image conditions are controlled on the basis of the data input by the touching operation during the operations of "COPY COLOR" and "MAKE COPY IMAGE CLOSER TO COPY IMAGE". The first case to be considered is where the color correction key 25 is pressed as described previously to perform the input operation employing the color circle 1 as shown in FIG. 7. When the "COPY COLOR" is input by pressing the color circle, the voltages in the X-axis and Y-axis directions in the touch key 8 change, and thus data to be fetched by the CPU 21 through the A/D converter 30 varies. For example, if the bottom left point in the digitizer sheet 40 is determined as the origin, the top right coordinate is (30, 0) and the top left coordinate is (0, 20). Therefore, if the origin of the detected voltages which are produced in the X-axis and Y-axis directions by pressing the color circle 1 are 1.8 V and 3.7 V, the coordinate corresponding to the pressed points represented by both 1.8 V in the X-axis direction and 3.7 V in the Y-axis direction is:

$$\frac{1.8\ V}{5\ V} \times \frac{150\ mm}{5\ mm} = 10.8 \quad \therefore X = 10$$

$$\frac{3.7\ V}{5\ V} \times \frac{100\ mm}{5\ mm} = 14.8 \quad \therefore Y = 14$$

Thus, it is determined that the coordinate of the pressed point is (10, 14).

Figure 11A:
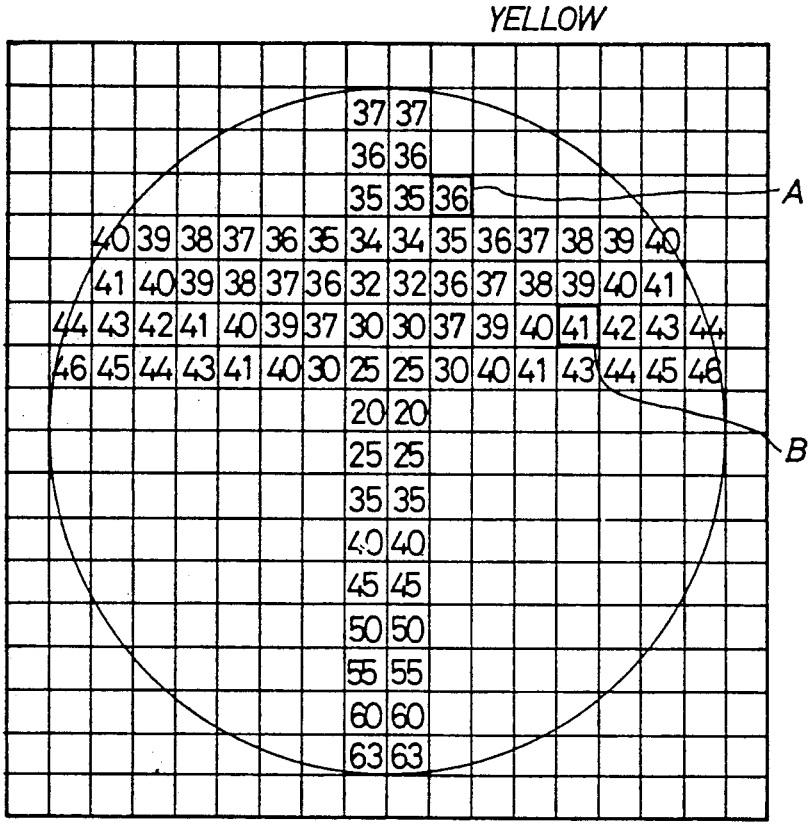
FIGS. 11(*a*) to 11(*d*) are diagrams corresponding to exposure data coordinates according to the first embodiment.
Figure 11B:
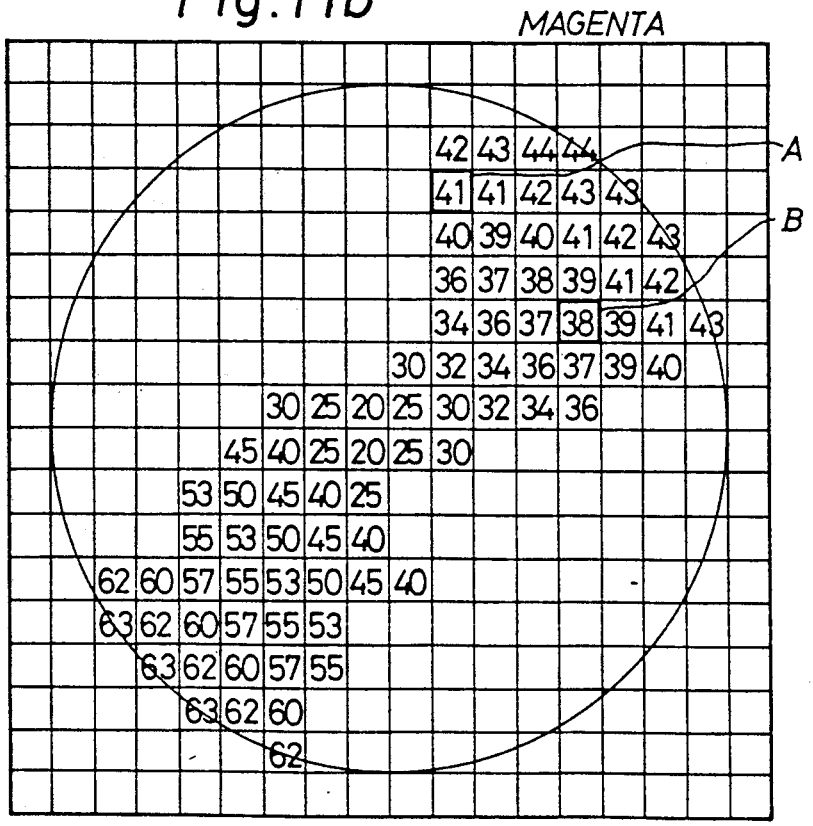
Figure 11C:
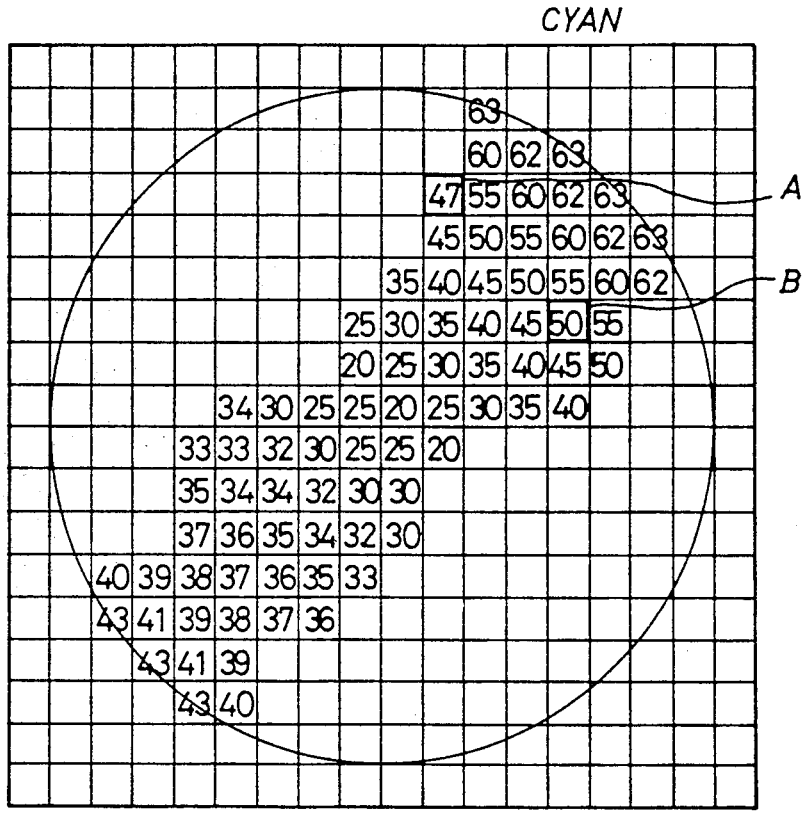
Figure 12A:
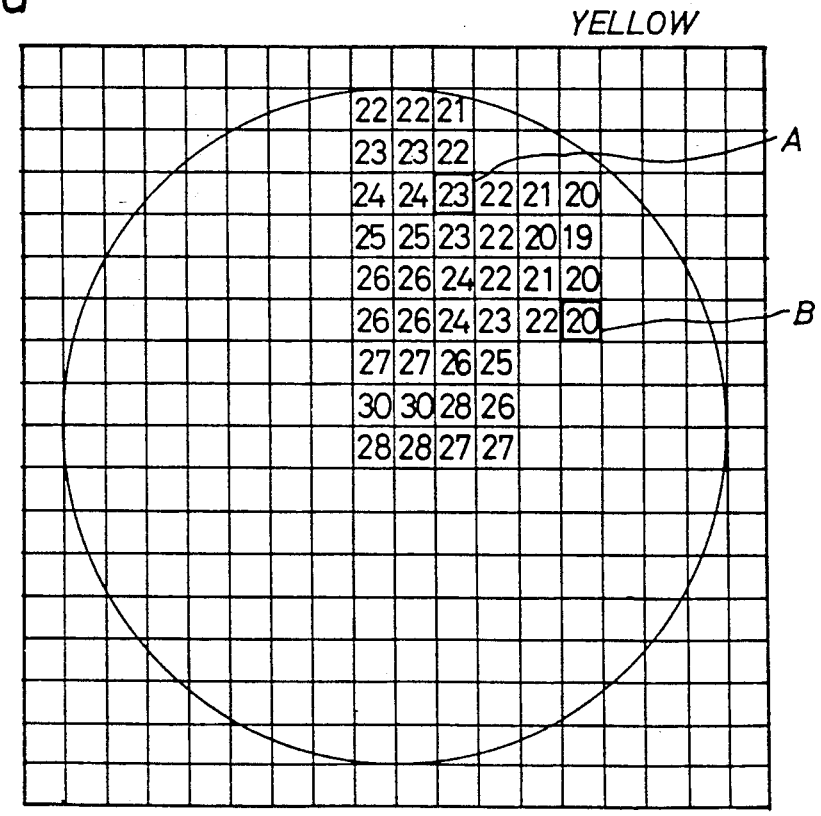
FIGS. 12(*a*) to 12(*d*) are diagrams corresponding to main-chart data coordinates according to the first embodiment.
Figure 12B:
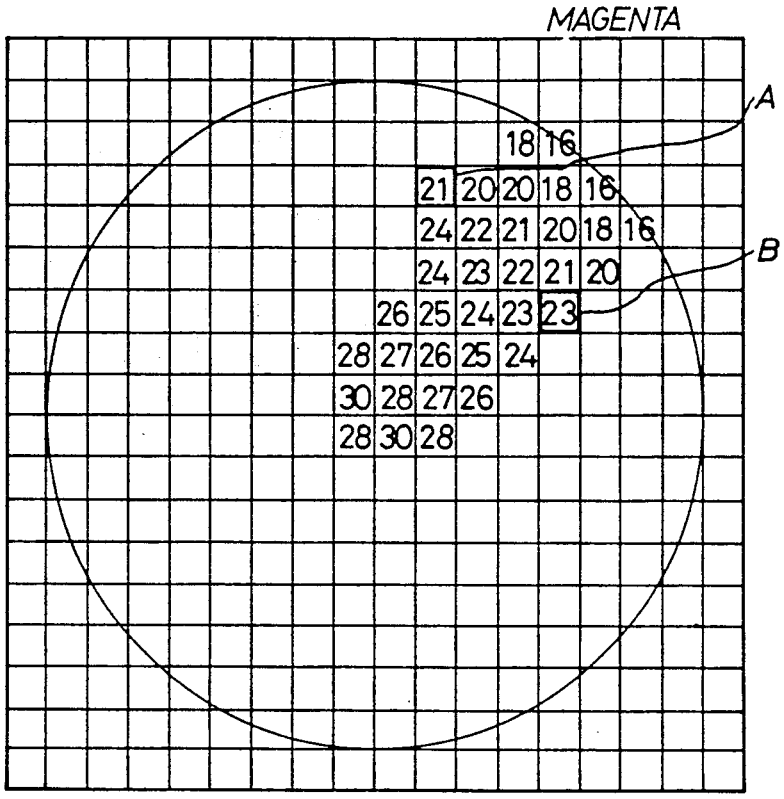
Figure 12C:
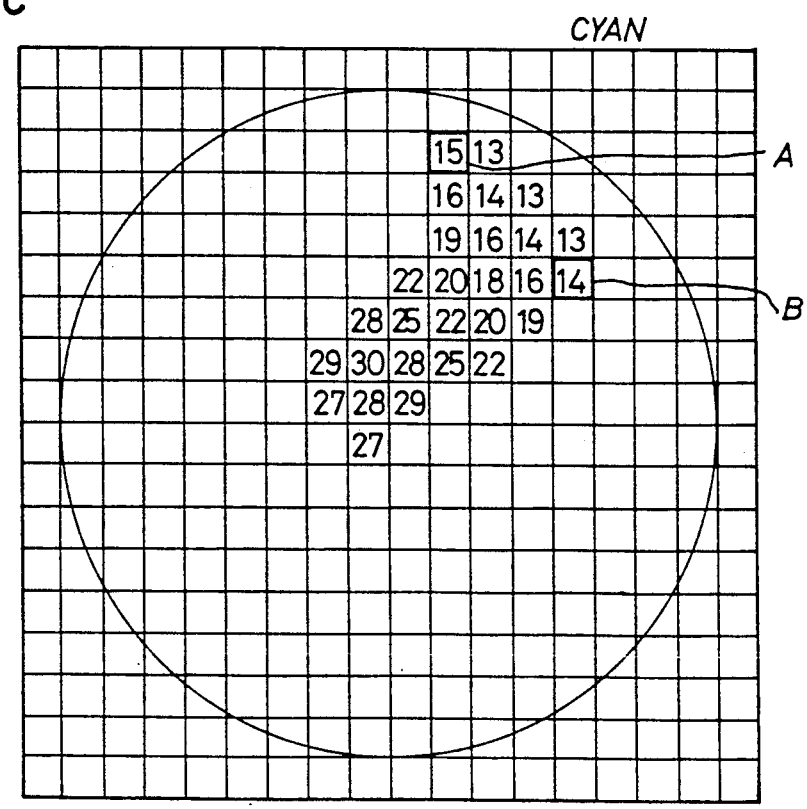
Figure 13A:
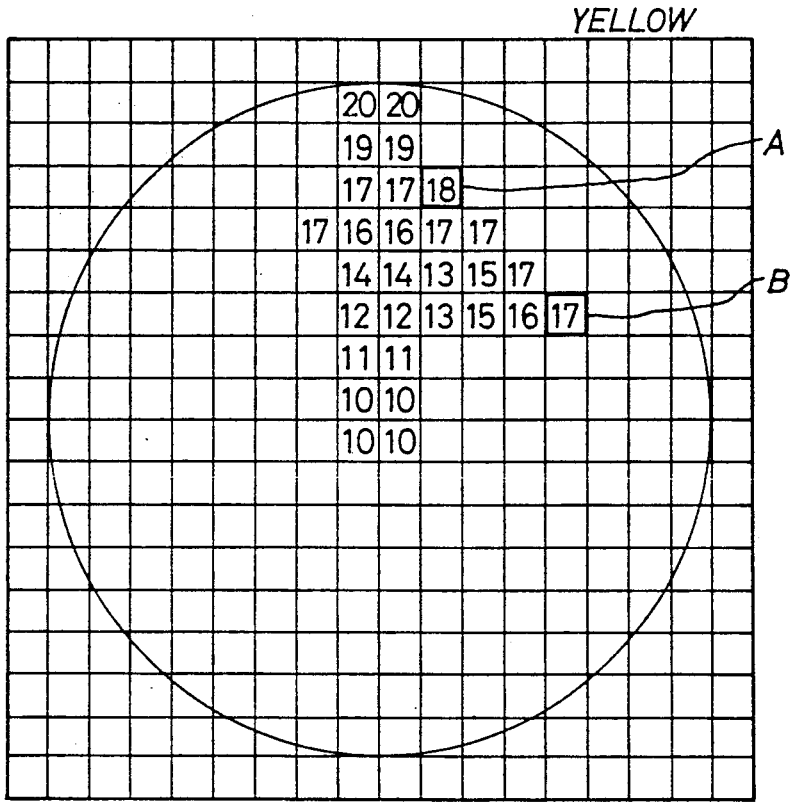
FIGS. 13(*a*) to 13(*d*) are diagrams corresponding to development-bias data coordinates according to the first embodiment.
Figure 13B:
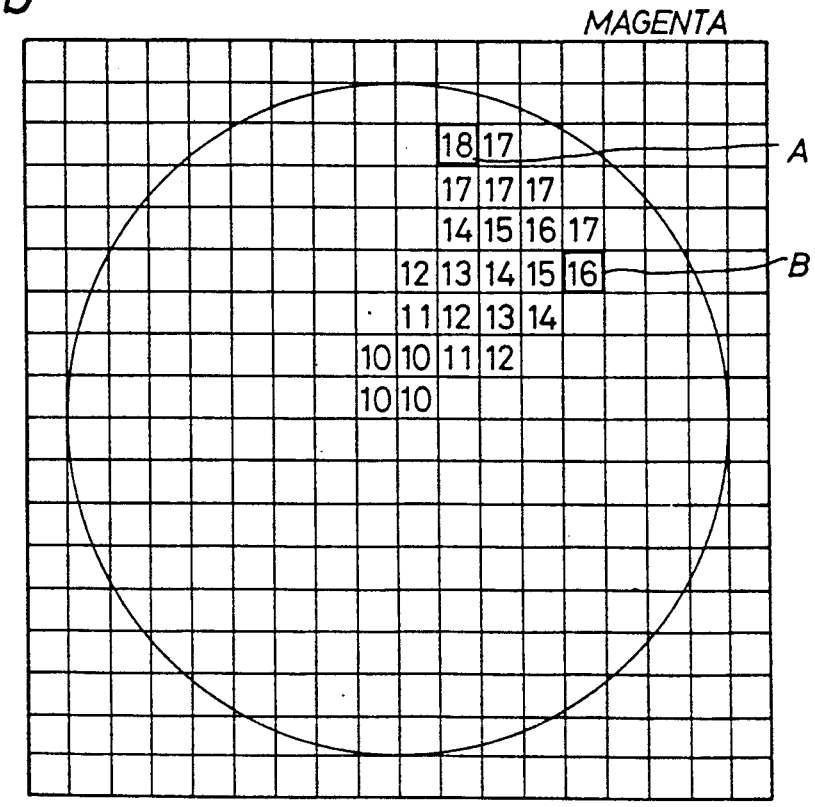
Figure 13C:
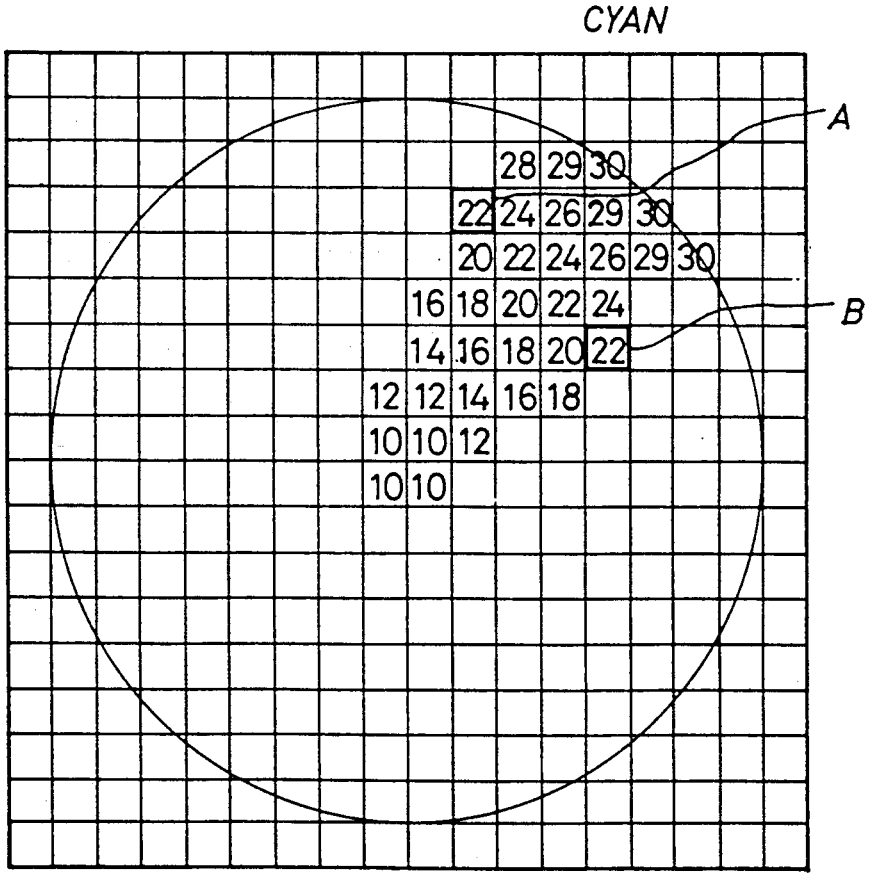

FIGS. 11, 12 and 13 are respectively a set of diagrams corresponding to the coordinates of exposure data, a set of diagrams corresponding to the coordinates of main-charge data, and a set of diagrams corresponding to the coordinates of development bias data stored in ROM 22. Each set includes independent diagrams for yellow, magenta and cyan, respectively. It is found that the coordinate (10, 14) of the pressed point which has been detected in the previous manner corresponds to a point A in each of the coordinate diagrams illustrated in FIGS. 11(*a*) to 13(*c*). Thus, it is found that the pressed point which has been operated for specifying a "COPY COLOR" input is within the color circle 1, and the corresponding LEDs 17 are turned on as described previously. Simultaneously, the exposure data for each of yellow, magenta and cyan which corresponds to this pressed point A, that is, the exposure data representative of each of Y=36, M=41 and C=47 shown in the respective diagrams FIG. 11(*a*), FIG. 11(*b*) and FIG. 11(*c*) is output as color distribution data for a bar-graph display.

Instead of the exposure data, the main-charge data or the development bias data may be used as the color distribution data to be displayed on the display panel 7. However, in general, it is preferable to use the exposure data, since the value of the exposure data greatly varies and a visible display can be obtained. If the bars of yellow, magenta and cyan on the display panel 7 are each constituted by twenty display segments, since the exposure data varies in the range of 0 to 63 bits, the previously described exposure data may be represented by:

$$\text{Yellow } Y = \frac{63 - 36}{63} \times 20 \approx 9$$

$$\text{Magenta } M = \frac{63 - 41}{63} \times 20 \approx 7$$

$$\text{Cyan } C = \frac{63 - 47}{63} \times 20 \approx 5$$

Therefore, the above number of display segments of each of the colors may be turned on to provide bar-graph display of the exposure data. Accordingly, the color distribution display provided on the display panel 7 represents the ratio of yellow to magenta to cyan of the color which has been input by the user's pressing operation.

Similarly, a point B in each of FIGS. 11 to 13 indicates a second pressed point when the "ORIGINAL COLOR" has been input by again pressing the color circle 1. Table 1 shows the exposure data, the main-charge data and the development bias data for each of yellow, magenta and cyan at the points A and B in each of FIGS. 11(*a*) through 13(*d*), the points A and B corresponding to the two points on the color circle 1 which the user has pressed for the purpose of color correction.

TABLE 1

| | EXPOSURE | MAIN CHARGE | DEVELOPMENT BIAS |
|---|---|---|---|
| A | | | |
| YELLOW | 36 | 23 | 18 |
| MAGENTA | 41 | 21 | 18 |
| CYAN | 47 | 15 | 22 |
| B | | | |
| YELLOW | 41 | 20 | 17 |
| MAGENTA | 38 | 23 | 16 |
| CYAN | 50 | 14 | 22 |

Each of the values shown in Table 1 represents the number of bits. The exposure data is represented by 0 to 63 bits, the amount of variation per bit is 1.5 V, and its minimum voltage level is 40 V. The main-charge data is represented by 0 to 31 bits, one bit corresponds to 10 $\mu$A, and the minimum amperage of the main-charge data is 25 $\mu$A. The development bias data is represented by 0 to 31 bits, one bit corresponds to 11 V, and its minimum voltage level is 57 V. The exposure/main-charge/development bias output section 32 acts upon each load in accordance with such a set of data. The partially extracted values shown in each of FIGS. 11(*a*) through 13(*d*) represent such bit data, but it will be understood that, although not shown, a predetermined value is actually assigned to each blank coordinate.

By way of example, the case of the exposure data will be discussed. It is assumed that the CPU 21 supplies a command to turn on the exposure lamp to the exposure/main-charge/development bias output section 32 through the I/O port 24 in accordance with the 50-bit exposure data. At this time, the actual exposure output is:

$$40\ V + 50\ \text{bits} \times 1.5\ V = 115\ V$$

In general, the user desires to correct color in a case where, when a color copy is produced from a color original document, the resultant copy color differs from the original color. Therefore, the exposure data, the main-charge data and the development bias data can be separately corrected so that, in Table 1, the colors at the point A can be actually reproduced as the corresponding colors at the point B. Since the amount of correction is represented by, for example, the difference between the data at the point A and the data at the point B in Table 1, the correction data shown in Table 2 is obtained.

TABLE 2

| | EXPOSURE | MAIN CHARGE | DEVELOPMENT BIAS |
|---|---|---|---|
| YELLOW | +5 | −3 | −1 |
| MAGENTA | −3 | +2 | −2 |
| CYAN | +3 | −1 | ±0 |

Therefore, if the outputs representative of the exposure data, the main-charge data and the development bias data for each of yellow, magenta and cyan at the time of a copying operation before color correction are incremented or decremented in accordance with the correction data shown in Table 2, the outputs of yellow, magenta and cyan are each corrected by the amount equivalent to the difference between the colors at the points A and B so that the thus-corrected outputs are obtained at the time of the copying operation after the color correction.

The above color correction will be described in greater detail with reference to an illustrative example. It is assumed hereinafter that the levels of the exposure output, the main-charge output and the development bias output for each of yellow, magenta and cyan before color correction are as shown in Table 3(*a*), 3(*b*) and 3(*c*), respectively.

TABLE 3(a)

| YELLOW (BEFORE CORRECTION) | | |
|---|---|---|
| EXPOSURE OUTPUT | 85 V | (= 40 + 30 × 1.5) |
| MAIN-CHARGE OUTPUT | 400 μA | (= 250 + 15 × 10) |
| DEVELOPMENT-BIAS OUTPUT | 222 V | (= 57 + 15 × 11) |

TABLE 3(b)

| MAGENTA (BEFORE CORRECTION) | | |
|---|---|---|
| EXPOSURE OUTPUT | 82 V | (= 40 + 28 × 1.5) |
| MAIN-CHARGE OUTPUT | 410 μA | (= 250 + 16 × 10) |
| DEVELOPMENT-BIAS OUTPUT | 200 V | (= 57 + 13 × 11) |

TABLE 3(c)

| CYAN (BEFORE CORRECTION) | | |
|---|---|---|
| EXPOSURE OUTPUT | 88 V | (= 40 + 32 × 1.5) |
| MAIN-CHARGE OUTPUT | 420 μA | (= 250 + 17 × 10) |
| DEVELOPMENT-BIAS OUTPUT | 233 V | (= 57 + 16 × 11) |

From the above output data, the following output data is obtained after color correction.

TABLE 4(a)

| YELLOW (AFTER CORRECTION) | | |
|---|---|---|
| EXPOSURE OUTPUT | 92.5 V | (= 40 + 35 × 1.5) |
| MAIN-CHARGE OUTPUT | 370 μA | (= 250 + 12 × 10) |
| DEVELOPMENT-BIAS OUTPUT | 211 V | (= 57 + 14 × 11) |

TABLE 4(b)

| MAGENTA (AFTER CORRECTION) | | |
|---|---|---|
| EXPOSURE OUTPUT | 77.5 V | (= 40 + 25 × 1.5) |
| MAIN-CHARGE OUTPUT | 430 μA | (= 250 + 18 × 10) |
| DEVELOPMENT-BIAS OUTPUT | 178 V | (= 57 + 11 × 11) |

TABLE 4(c)

| CYAN (AFTER CORRECTION) | | |
|---|---|---|
| EXPOSURE OUTPUT | 98 V | (= 40 + 32 × 1.5) |
| MAIN-CHARGE OUTPUT | 410 μA | (= 250 + 16 × 10) |
| DEVELOPMENT-BIAS OUTPUT | 233 V | (= 57 + 16 × 11) |

Thus, the two points on the color circle 1 which the user has pressed for the purposes of color correction are detected through the system of the touch key 8, and the difference between the values of each of the exposure data, the main-charge data and the development bias data for each of yellow, magenta and cyan at these pressed points is obtained from ROM22 through CPU21, whereby all the data (each representing a middle value which is in advance set so that a standard image can be obtained) is incremented or decremented by the above difference. In consequence, the user can accomplish the desired correction of color.

As described above, in the color adjustment according to this embodiment, the user can select and input a desired color or colors while referring to the color circle 1 on the operation section 3 and visually confirming a distinct color-to-color correspondence. Also, since the color tone of the original document can be identified from the color circle 1, the user can easily specify a color to be corrected at the time of the correction of the copy color and input it by the touch of a finger without using any special tool such as a pen or a mouse. In particular, when the color circle 1 is visually represented by real colors, the user can transmit the desired color which he has image directly to the machine as compared with a numerical value input system. Also, since all the color characteristics are contained in the color circle 1, even a user who has no knowledge of the constituent elements of color (hue, brilliance and saturation) can easily perform an input operation for color correction without the need for any special learning or training. Furthermore, since all the operating elements required for the input operation for color correction are contained in a single color circle 1, the number of keys of the operating section can be reduced and hence the construction of the operation section 3 can be simplified.

A second embodiment of the present invention will be described below with reference to FIGS. 14(*a*) and 14(*b*). The second embodiment also employs a color chart system such as that used in the first embodiment, and is assumed to utilize the same contents which have been referred to in the description of the first embodiment.

First, the first embodiment will be discussed in greater detail. If the state of the copying machine is not stable, for example, if the state of a developer or the photosensitive member varies by the influence of the environment, a copy color desired to be actually reproduced from a particular color of the original document is selected with reference to the visual color circle 1 (by pressing two points), and the difference data is calculated and added to a reference output (the output based on the middle-value data stored in ROM 22). Therefore, the user can produce a copy with desired colors. However, a truly good operability means that no color adjustment is required. In this case, if the state of the copying machine is not stable, the initial copy in each copying operation will not be reproduced in the desired color. Therefore, since the same copying operation must be again performed, it cannot be said that the operability is truly good.

In the above-described color chart input system of the second embodiment, the corrected data after the user has made a color adjustment is stored in ROM 22, and this data is reflected in the subsequent color copying operation. More specifically, the preset relationship of "middle-value data=reference data" may not be a fixed one and, each time a color adjustment is made and one copying operation is performed, the preceding reference data may be updated with the adjusted data after color correction. Thus, an automatic color correction function for a color copying operation without involving color adjustment can be obtained, and the subsequent copying operation can be performed without the need for any color adjustment operation. The above arrangement has been devised by noting the actual operation by users. More specifically, if the copying conditions have varied to such an extent that the desired color copy is not obtained and the density of toner of a particular color, for example, yellow Y increases, the actual copy produced from the original document will be yellowish. In this case, the user will make color adjustment so that the yellow Y may be made light. In other words, in a case where any imbalance of color occurs in the machine, there is a tendency for common users to make a color adjustment so as to lessen the excessive portions of the imbalance. Accordingly, if the color adjustment operation has been performed, the resultant corrected data can be used as reference data.

Figure 14A:
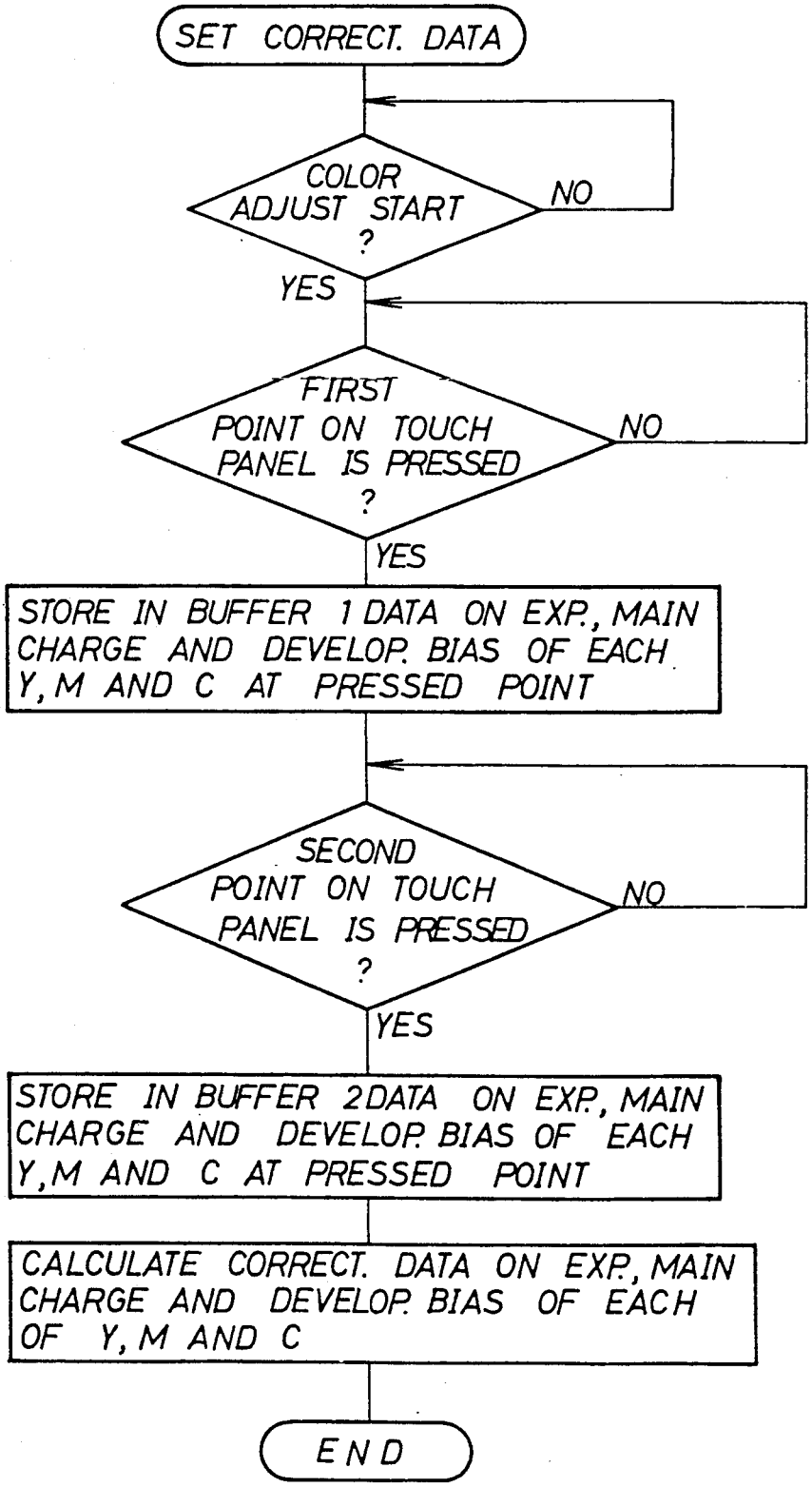
FIGS. 14(*a*), 14(*b*) and 15 are flow charts which serve to illustrate a second embodiment of the present invention.
Figure 14B:
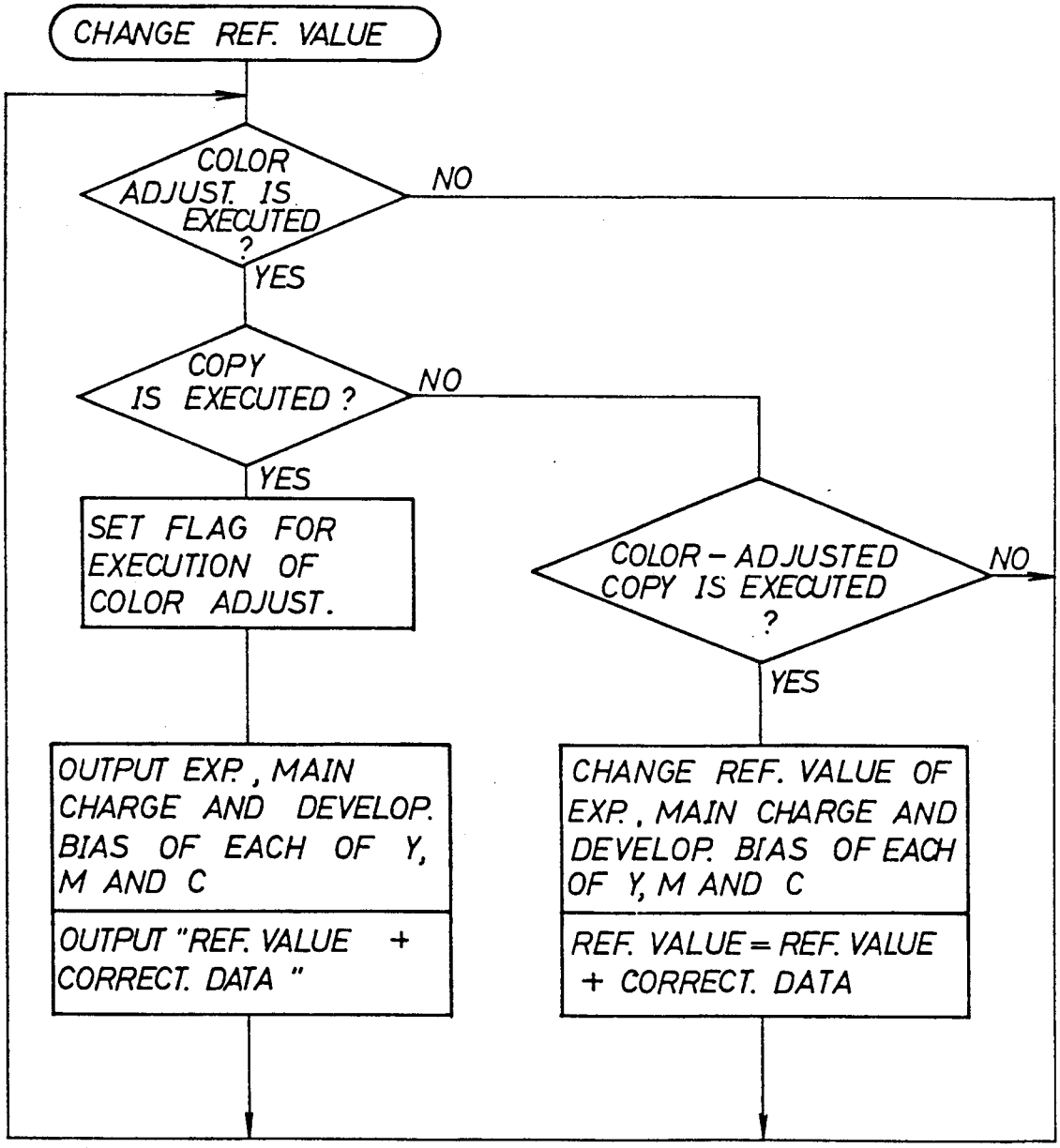

FIG. 14(*a*) is a flow chart which corresponds to the flow chart of the first embodiment shown in FIG. 9, and FIG. 14(*b*) is a flow chart showing a process for altering the reference data for color correction after color copying involving a color adjustment operation which has been executed. In other words, means for effecting the process shown in FIG. 14(*b*) in flow chart form constitutes reference-data altering means.

Accordingly, in the case of the previously described concrete example, the reference data before color adjustment is:

TABLE 5(a)

| REFERENCE DATA (BEFORE CORRECTION) | | | |
|---|---|---|---|
| | EXPOSURE | MAIN CHARGE | DEVELOPMENT BIAS |
| YELLOW | 30 | 15 | 15 |
| MAGENTA | 28 | 16 | 13 |
| CYAN | 32 | 17 | 16 |

If color adjustment has been performed, the corrected data (refer to Table 2) after color adjustment is calculated in accordance with the flowchart of FIG. 14(*a*), and the old reference data is updated with the following reference data.

TABLE 5(b)

| REFERENCE DATA (AFTER CORRECTION) | | | |
|---|---|---|---|
| | EXPOSURE | MAIN CHARGE | DEVELOPMENT BIAS |
| YELLOW | 35 | 12 | 14 |
| MAGENTA | 25 | 18 | 11 |
| CYAN | 35 | 16 | 16 |

In this manner, the reference data used for color adjustment is updated in ROM22 through CPU21 each time one color copying operation accomplished by color adjustment is executed. Accordingly, a desired color copy can be produced only be executing an ordinary color copying operation, that is, by operating the copying start key, irrespective of the state of the machine.

If the visual color circle 1 of the second embodiment which is formed in real color is utilized, it is in principle possible to cause the copying machine to perform a color copying operation by specifying color conversion from one arbitrary color to another arbitrary color. In other words, there may be a case where the color circle 1 is utilized not for color adjustment but for color change. If such a function is utilized to effect an extreme conversion of hue, for example conversion from red to blue, there would be a case where a color which the user does not desire to convert is changed into a different color. In such a case as well, if the function of automatically updating the reference data operates, the reference data before updating is altered, even if correct. As a result, when an ordinary color copy is produced from an original, there is a risk that the obtained copy may utterly differ in color from the original.

In the light of the above problems, the second embodiment contemplates the achievement of the easy operation of specifying color conversion in substantially the same hue. Therefore, a correctable area, the color of which can be corrected, is selected so that the original color within the range of hue approximate to that of an initially specified copy color. As shown in FIG. 7(*c*), the area in the color circle 1 which corresponds to an array of five of the LEDs 17 as shown in FIG. 7(*c*) is specified as such a correctable area, and it is checked whether the color indicated by a point which has been pressed during an "ORIGINAL COLOR" inputting operation is located within the area.

Figure 15:
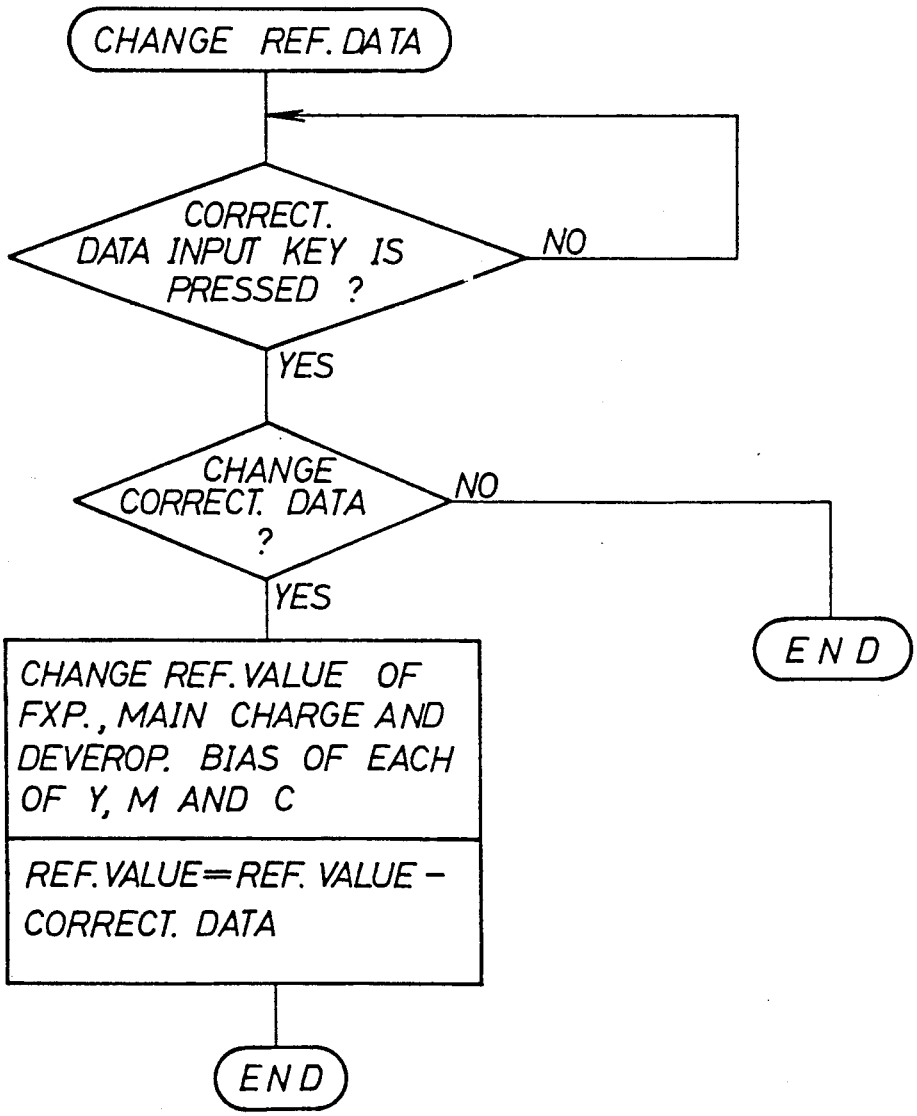

In the second embodiment, to avoid accidental updating or alteration of the reference data, as shown in FIG. 3, the operating section 3 is provided with a corrected data input key 81 for determining whether or not updating of the reference data is performed at the time of color adjustment. As shown in the flow chart of FIG. 15, if the corrected data input key 81 is not being pressed, alteration of the reference is inhibited. It is therefore possible to prevent the reference from being unnecessarily changed at the time of color change or a special copying operation.

Figure 16A:
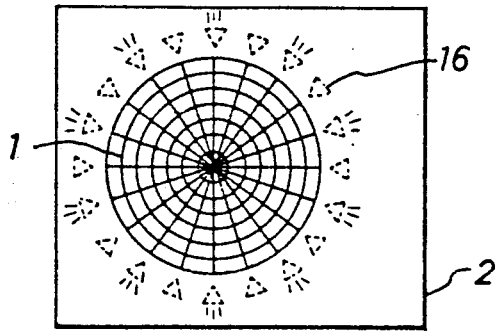
FIGS. 16(*a*) and 16(*b*) are diagrammatic plan views illustrating the procedure of operation of a color circle in a third embodiment.
Figure 16B:
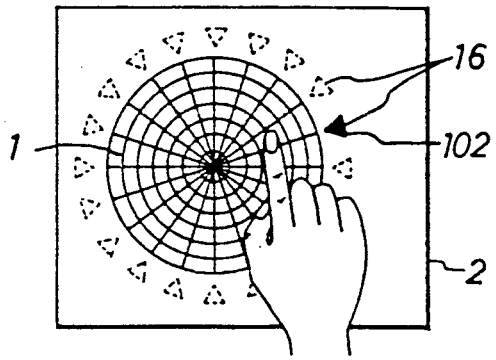
Figure 17A:
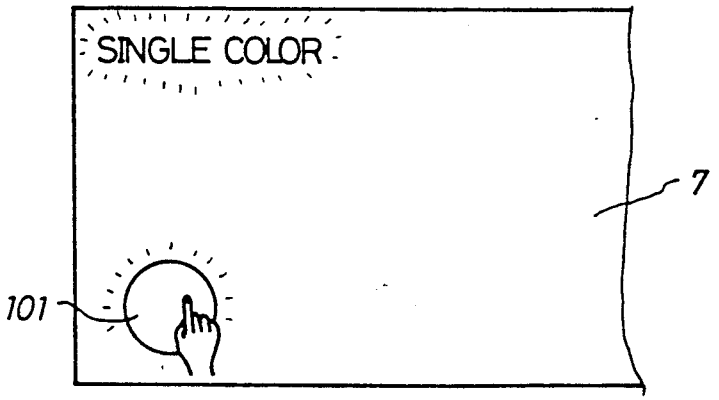
FIGS. 17(*a*) to 17(*d*) are diagrammatic plan views which serve to illustrate a sequence of variations of the visual display provided on a display panel in the third embodiment.
Figure 17B:
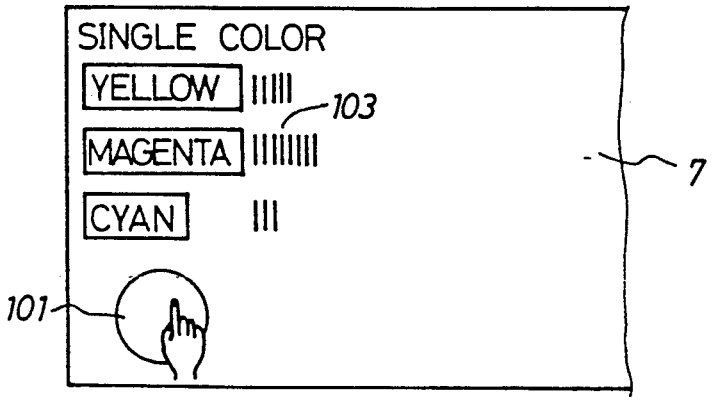

A third embodiment of the present invention will be described with reference to FIGS. 16 through 18. In the third embodiment, there is provided a full-color copying machine, such as that shown in FIG. 1, which allows inputting and adjustment of a single color. Since this embodiment is basically a modified version of the first embodiment, in FIGS. 16 to 18, like reference numerals are used to denote the like or corresponding elements illustrated in the first embodiment.

More specifically, the full-color copying machine shown in FIG. 1 is capable of producing a single-color copy by suitably combining the three kinds of toner: yellow (Y) toner, magenta (M) toner and cyan (C) toner. In the third embodiment, a color chart is used to specify a single color for the purpose of producing a single-color copy. The color circle 1 such as that used in the first embodiment shown in FIG. 2 may be employed as such a color chart. In the third embodiment, the color adjustment section shown in FIG. 3 functions as a single-color selecting and inputting section. The remaining portions are the same as those of the color circle 1 which has been referred to in the description of the first embodiment.

The procedure of the operation of selecting a single color employing the color circle 1 and the associated circuits in the third embodiment having the above-described construction will be diagrammatically described below with reference to FIGS. 16(*a*) to 17(*b*). When a single-color key 27 of the operating section 3 is pressed, a sign representative of "SINGLE COLOR" and a color-circle image which corresponds to the configuration of the color circle 1 are visually displayed on the display panel 7 as shown in FIG. 17(*a*) (refer to 101) and are displayed by flashes of light on the display panel 7 (refer to 101). Simultaneously, the LEDs 17 located on the extensions of the radial axes of the respective ten hue areas of the color circle 1, as described previously, emit flashes of light through the LED display portions 16, and informs a user what color can be selected from the colors on the color circle 1. Specifically, these displays instruct the user to select and input a single color by touching the color circle 1 such as that shown in FIG. 16(*a*). In accordance with such an instruction, the user inputs the selected color by the touch of his finger as shown in FIG. 16(*b*). Since the color circle 1 visually represents all the real colors, the user may press a portion corresponding to the desired single color by the touch of his finger. The LED 17 (the LED display section 16) corresponding to the pressed portion is turned on to provide an indication. In FIG. 16(*b*), a black triangle represents the LED (shown at 102) which has been turned on. In the meantime, as shown in FIG. 17(*b*), the color distribution of the color elements of the selected single color is displayed on the display panel 7 by means of a plurality of parallel bars (shown at 103) which are typically used with graphic equalizers. This color distribution is that of the three primary colors utilized in an ordinary development process, that is, the color components of yellow, magenta and cyan. Therefore, the user can readily identify the characteristics of the selected single color. Upon completion of an input operation employing the color circle 1, the signal indicative of "SINGLE COLOR" on the display panel 7 is switched from a flashing state to a steadily lit state.

Figure 18:
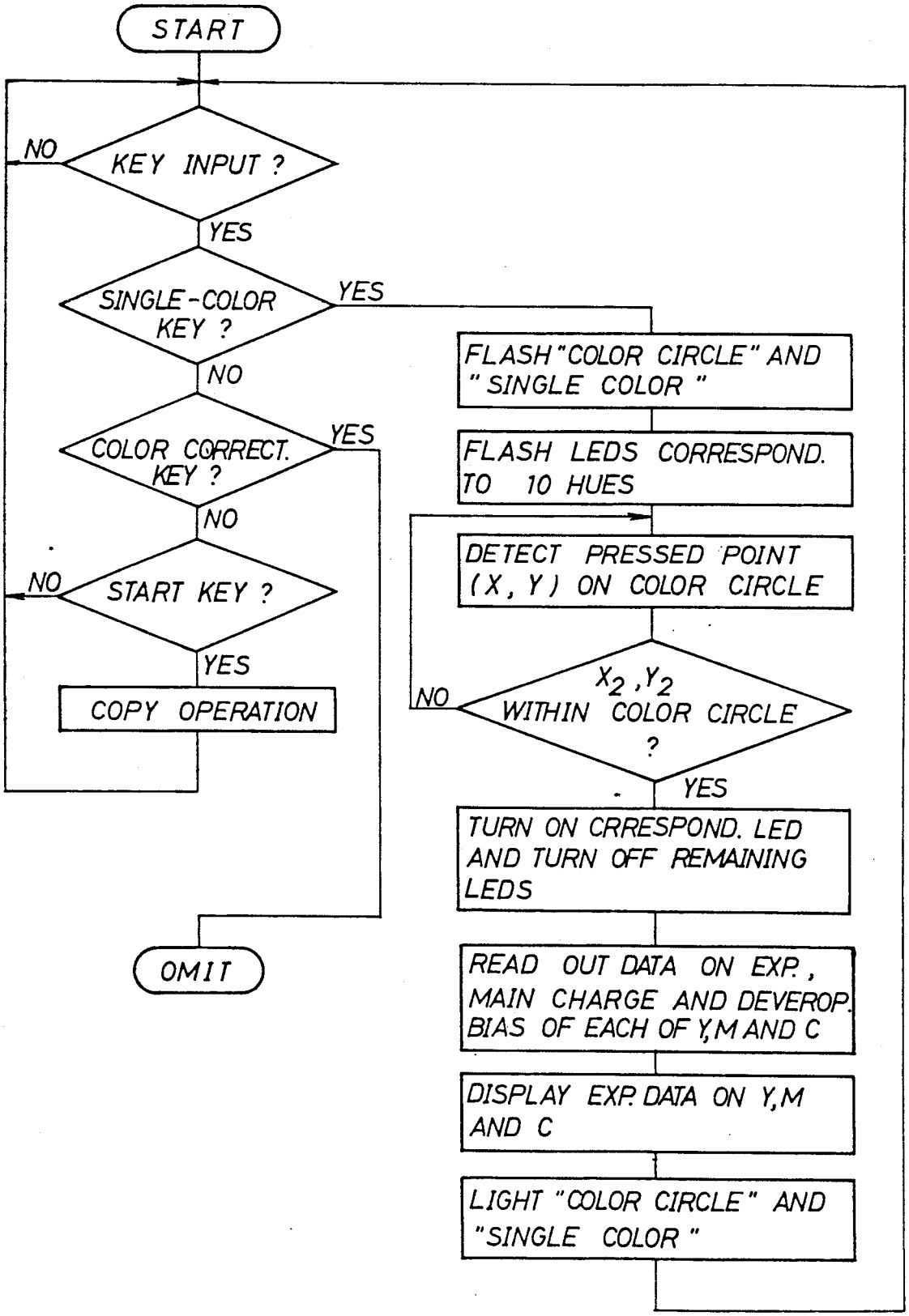
FIG. 18 is a flow chart of various processes executed according to the third embodiment.
Figure 19A:
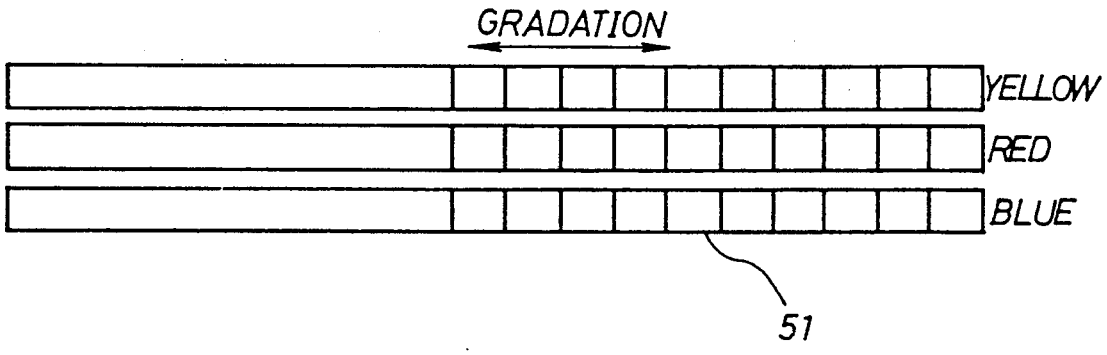
FIGS. 19(*a*) to 19(*d*) are schematic plan views showing several modifications the color chart for use in the present invention.
Figure 19B:
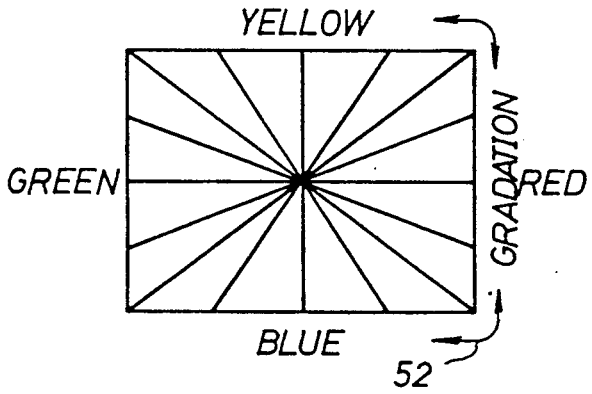
Figure 19C:
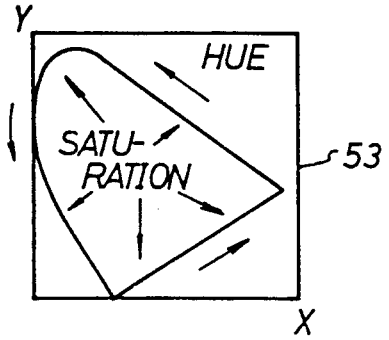
Figure 19D:
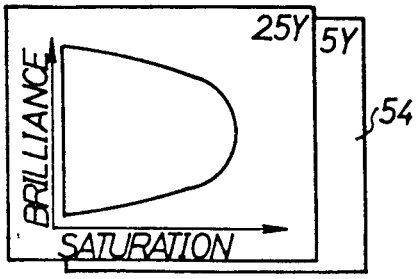

FIG. 18 is a flow chart showing the flow of the displays and processes which are executed during the above operation using both the single-color key 27 and the color circle 1.

The detection of input positions which is executed in association with the above-described operation on the color circle 1 is substantially identical with that described in connection with FIG. 10. Fetching of data from ROM22 and control of image-forming conditions relative to the single color on the basis of both the specification and selection of the single color and the detection of the pressed point is basically identical with those of the first embodiment. By way of example, the case will first be considered where the single-color key 27 is pressed as described previously to perform the input operation employing the color circle 1 as shown in FIG. 16. In this embodiment as well, a diagram corresponding to the exposure data coordinate, a diagram corresponding to the main-charge data coordinate and a diagram corresponding to the development bias data coordinate are incorporated in advance, and these diagrams are separately provided for yellow Y, magenta M and cyan C. As described previously, the coordinate (10, 14) of the pressed point which has been thus detected is the point A in each of the coordinate diagrams shown in FIGS. 11(*a*) to 13(*c*). Thus, it is determined that the pressed point which has been operated for specifying a "SINGLE COLOR" input is within the color circle 1, and the corresponding LED 17 is turned on as described previously. Simultaneously, the exposure data for each of yellow, magenta and cyan which corresponds to this pressed point A, that is, the exposure data representative of each of Y=36, M=41 and C=47 shown in the diagrams FIG. 11(*a*), FIG. 11(*b*) and FIG. 11(*c*) is output as color distribution data for bar-graph display.

Instead of the exposure data, the main-charge data or the development bias data may be used as the color distribution data to be displayed on the display panel 7. However, in general, it is preferable to use the exposure data, since the value of the exposure data greatly varies and a visible display can be obtained. If the bars of yellow, magenta and cyan on the display panel 7 are each constituted by twenty display segments, since the exposure data varies in the range of 0 to 63 bits, the previously described exposure data may be represented by:

$$\text{Yellow } Y = \frac{63 - 36}{63} \times 20 \approx 9$$

$$\text{Magenta } M = \frac{63 - 41}{63} \times 20 \approx 7$$

$$\text{Cyan } C = \frac{63 - 47}{63} \times 20 \approx 5$$

Therefore, the above number of display segments of each of the colors may be turned on to provide a bar-graph display of the exposure data. Accordingly, the color distribution display provided on the display panel 7 represents the ratio of yellow to magenta to cyan of the color which has been input by the user's pressing operation.

Similarly, the main-charge data and the development bias data for each of yellow, magenta and cyan at the point A on the color circle 1 which has been pressed is calculated as shown in FIGS. 12(*a*) to 12(*c*). Table 6 shows the previously described exposure data, the main-charge data and the development bias data

TABLE 6

| | EXPOSURE | MAIN CHARGE | DEVELOPMENT BIAS |
|---|---|---|---|
| YELLOW Y | 36 | 23 | 18 |
| MAGENTA M | 41 | 21 | 18 |
| CYAN C | 47 | 15 | 22 |

Similarly to Table 6, each of the values shown in Table 6 represents the number of bits. As compared with Table 1, Table 6 shows the data corresponding to the A coordinate alone, but there is no data corresponding to the B coordinate.

In accordance with Table 1, the levels of the exposure output, the main-charge output and the development bias output for each of yellow Y, magenta M and cyan C which are derived from the pressing of the point A are as shown in the following tables.

TABLE A

| YELLOW Y | | |
|---|---|---|
| EXPOSURE OUTPUT | 94 V | (= 40 + 36 × 1.5) |
| MAIN-CHARGE OUTPUT | 480 μA | (= 250 + 23 × 10) |
| DEVELOPMENT-BIAS OUTPUT | 255 V | (= 57 + 18 × 11) |

TABLE B

| MAGENTA M | | |
|---|---|---|
| EXPOSURE OUTPUT | 101.5 V | (= 40 + 41 × 1.5) |
| MAIN-CHARGE OUTPUT | 460 μA | (= 250 + 21 × 10) |
| DEVELOPMENT-BIAS OUTPUT | 255 V | (= 57 + 18 × 11) |

TABLE C

| CYAN (BEFORE CORRECTION) | | |
|---|---|---|
| EXPOSURE OUTPUT | 110.5 V | (= 40 + 47 × 1.5) |
| MAIN-CHARGE OUTPUT | 420 μA | (= 250 + 15 × 10) |
| DEVELOPMENT-BIAS OUTPUT | 299 V | (= 57 + 22 × 11) |

Based on the exposure data, the main-charge data and the development bias data for each of yellow Y, magenta M and cyan C, the copying condition for toner of each color is controlled and a copying operation is executed similarly to the ordinary color copy operation. Thus, a single-color copy of the color which has been specified by the pressing operation of the color circle 1 is obtained.

As described above, in accordance with the third embodiment, the user can select a single color to be copied from among the colors on the color circle 1 which is represented by real colors. Also, the user can input the selected single color by the touch of his finger without using any special tool such as a pen or a mouse. In particular, since the color circle 1 is visually represented by real colors, the user can transmit the desired single color directly to the machine as compared with a numerical value input system. Even a user who has no knowledge of the constituent elements of color (hue, brilliance and saturation) can easily perform the operation of selecting and inputting a single color without the need for any special learning or training. Furthermore, since all the operating elements required for a single-color secting and inputting operation are contained in a single color circle 1, the number of keys of the operating section can be reduced and hence the construction of the operating section 3 can be simplified.

In each of the first, second and third embodiments, the color circle 1 is used as the color chart by way of example, but the form of the color chart is not limited to such a color circle. For example, a bar graph, a square graph, a triangular graph or a Munsell chart may be employed.

FIGS. 19(*a*) to 19(*d*) diagrammatically show several examples of such graphs.

FIG. 19(*a*) shows a color chart 51 which is an example of a bar-graph display. In this color chart 51, the hue of each of various colors such as yellow, red and blue is displayed in a bar-graph form such that the color tone is progressively changed. The color tone changes progressively along the block array which constitutes each bar illustrated in FIG. 19(*a*).

FIG. 19(*b*) shows a color chart 52 which is an example of the square graph. The display system of this square graph is similar to that of the color circle 1 used in the first to third embodiments.

FIG. 19(*c*) shows a color chart 53 which is an example using a XYZ colorimetric system according to the CIE (the International Commission on Illumination).

FIG. 19(*d*) shows a color chart 54 which is an example using the Munsell color system.

As illustratively shown in each FIGS. 19(*a*) to 19(*d*), it is possible to use graphs of any kind that can represent each single color in real color.

What is claimed is:

1. A color adjustment apparatus for a color picture image reproducing machine, comprising:

(a) a color chart for visually representing all real colors in terms of color elements of saturation and hue;

(b) a key structure adjacent said color chart for detecting a color pressed on said color chart;

(c) storage means for storing color adjustment data; and (d) an input means for retrieving color adjustment data from said storage means and for inputting said data to said color reproducing machine, said color adjustment data being related to a color corresponding to the pressed point on said color chart.

2. The apparatus according to claim 1, wherein said color chart comprises a color circle representing hue gradation along a circumferential direction thereof and saturation gradation along a radial direction thereof, said hue gradation being based on the ten hues of the Munsell color system.

3. The apparatus according to claim 2, wherein said hues on a concentric color circle a radius of which is half a radius of said color circle are set as basic colors, and said colors of said color circle become progressively bright and light outwardly in said radial direction and progressively dark and dim inwardly in said radial direction.

4. The apparatus according to claim 1, wherein said color picture image reproducing machine comprises one of an analogue color copying machine and a digital color copying machine.

5. The apparatus according to claim 1, wherein said key structure includes a first electrode plate having first electrodes printed thereon in a first direction and a second electrode plate having second electrodes printed thereon in a second direction perpendicular to said first direction, said first and second electrode plates being placed one above the other.

6. An apparatus according to claim 5, wherein said first and second electrodes are connected to opposite sides of a voltage source, with a first ammeter measuring the total current through the circuit, a second ammeter measuring the current through the first electrodes and a third ammeter measuring the current through said second electrodes.

7. An apparatus according to claim 1, further comprising light emitting diodes corresponding to the different colors on said color chart, a light emitting diode being actuated when the corresponding color is pressed on the color chart.

8. An apparatus according to claim 1, further comprising a display panel for displaying said color adjustment data.

9. An apparatus according to claim 8, wherein the color adjustment data is displayed by way of a bar graph.

10. An apparatus according to claim 1, further comprising an output section for controlling a bias within said reproducing machine according to said data.

11. A color adjustment apparatus for a color picture image reproducing machine, comprising:

(a) a color chart for visually representing all real colors in terms of color elements of saturations and hue, (b) a key structure adjacent said color chart for detecting a color pressed on color chart;

(c) a storage means for storing reference data of each of exposure data, charging data and development bias data all of which relate to one of said colors on said color chart;

(d) a retrieving means connected to said touch-key structure and said storage means for retrieving from said storage means reference data relating to two colors corresponding to two pressed points on said color chart;

(e) a calculating means for receiving difference data between said inputted reference data for two pressed points on said color chart and for calculating at least one of exposure data, charge data, and development bias data on the basis of said reference data, (f) an instruction means for instructing an execution of a copying operation to said reproducing machine on the basis of said calculation of at least one of said exposure data, said charge data and said development bias data, and (g) a substituting means for substituting said calculation of at least one of said exposure data, said charge data and said development bias data for said reference data of said storage means, on every completion of said copying operation.

12. The apparatus according to claim 11, wherein said color chart comprises a color circle representing hue gradation along a circumferential direction thereof and saturation gradation along a radial direction thereof, said hue gradation being based on the ten hues of the Munsell color system.

13. The apparatus according to claim 12, wherein said hues on a concentric color circle a radius of which is half a radius of said color circle are set as basic colors, and said colors of said color circle become progressively bright and light outwardly in said radial direction and progressively dark and dim inwardly in said radial direction.

14. The apparatus according to claim 11, wherein said color picture image reproducing machine comprises one of an analogue color copying machine and a digital color copying machine.

15. The apparatus according to claim 11, wherein said key structure includes a first electrode plate having first electrodes printed thereon in a first direction and a second electrode plate having second electrodes printed thereon in a second direction perpendicular to said first direction, said first and second electrode plates being placed one above the other.

16. An apparatus according to claim 15, wherein said first and second electrodes are connected to opposite sides of a voltage source, with a first ammeter measuring the total current through the circuit, a second ammeter measuring the current through the first electrodes and a third ammeter measuring the current through said second electrodes.

17. An apparatus according to claim 11, further comprising light emitting diodes corresponding to the different colors on said color chart, a light emitting diode being actuated when the corresponding color is pressed on the color chart.

18. An apparatus according to claim 11, further comprising a display panel for displaying said color adjustment data.

19. An apparatus according to claim 18, wherein the color adjustment data is displayed by way of a bar graph.

20. An apparatus according to claim 11, further comprising an output section for controlling a bias within said reproducing machine according to said data.

21. A color adjustment apparatus for a color picture image reproducing machine, comprising:

(a) a color chart for visually representing a plurality of single-colors by means of real colors;

(b) a key structure adjacent said color chart for detecting a color pressed on said color chart;

(c) storage means for storing single color data of at least one of exposure data, charge data and development bias data all of which relate to corresponding single-colors;

(d) input means connected to said key structure for receiving the position of a pressed point of said color chart and retrieving single-color data from said storage means in response thereto; and (e) an instructions means for instructing an execution of a reproducing operation to said reproducing machine by controlling said single color data from said input means.

22. The apparatus according to claim 18, wherein said key structure includes a first electrode plate having first electrodes printed thereon in a first direction and a second electrode plate having second electrodes printed thereon in a second direction perpendicular to said first direction, said first and second electrode plates being placed one above the other.

23. An apparatus according to claim 19, wherein said first and second electrodes are connected to opposite sides of a voltage source, with a first ammeter measuring the total current through the circuit, a second ammeter measuring the current through the first electrodes and a third ammeter measuring the current through said second electrodes.

24. An apparatus according to claim 18, further comprising light emitting diodes corresponding to the different colors on said color chart, a light emitting diode being actuated when the corresponding color is pressed on the color chart.

25. An apparatus according to claim 18, further comprising a display panel for displaying said color adjustment data.

26. An apparatus according to claim 22, wherein the color adjustment data is displayed by way of a bar graph.

27. An apparatus according to claim 18, further comprising an output section for controlling a bias within said reproducing machine according to said data.

28. A color adjustment method for a color picture image reproducing machine, comprising the steps of:

selecting a color by pressing the representation of that color on a color chart which visually represents all real colors in terms of color elements of saturation and hue and has a key structure for detecting a color pressed on said color chart;

retrieving color adjustment data corresponding to the color selected from a storage device;

inputting said color adjustment data to said color reproducing machine.

29. A color adjustment method for a color picture image reproducing machine, comprising the steps of:

selecting a color by pressing the representation of that color on a color chart which visually represents all real colors in terms of color elements of saturation and hue and has a key structure for detecting a color pressed on said color chart;

storing reference data of each of exposure data, charging data and development bias data relating to each of said color on said color chart;

retrieving from storage said reference data relating to two colors corresponding to two pressed points on said color charts; and adjusting said reproducing machine based on the difference between the reference data for said two pressed points.

30. A color adjustment method according to claim 29, further comprising the steps of:

receiving the difference data between said inputted reference data for two pressed points on said color chart and for calculating at least one of the exposure data, charged data and development bias data on the basis of said reference data;

instructing and executing a copying operation to said reproducing machine on the basis of said calculation; and substituting said calculation for said reference data of said storage means.

31. A color adjustment method for a color picture image reproducing machine comprising the steps of:

selecting a color by pressing the representation of that color on a color chart which visually represents all real colors in terms of color elements of saturation and hue and has a key structure for detecting a color pressed on said color;

retrieving from a store means reference data relating to two colors corresponding to said pressed point on said color chart;

actuating a one-color-only key indicating that a single color is to be utilized; and executing a copying operation by controlling said single-color data.

* * * * *